US007127194B2

(12) United States Patent
Hoshi et al.

(10) Patent No.: US 7,127,194 B2
(45) Date of Patent: Oct. 24, 2006

(54) PROCESS CARTRIDGE, POSITIONING MECHANISM THEREFOR AND ELECTROPHOTOGRAPHIC IMAGE FORMING APPARATUS

(75) Inventors: Nobuharu Hoshi, Numazu (JP); Kazunari Murayama, Shizuoka-ken (JP); Hideki Maeshima, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 82 days.

(21) Appl. No.: 10/745,984

(22) Filed: Dec. 29, 2003

(65) Prior Publication Data

US 2005/0047820 A1 Mar. 3, 2005

(30) Foreign Application Priority Data

Aug. 29, 2003 (JP) ..... 2003-209843

(51) Int. Cl.
*G03G 21/16* (2006.01)

(52) U.S. Cl. ..... 399/111

(58) Field of Classification Search ..... 399/110–112, 399/116, 117
See application file for complete search history.

(56) References Cited

U.S. PATENT DOCUMENTS

| | | | | |
|---|---|---|---|---|
| 6,131,011 | A | 10/2000 | Kojima et al. | 399/351 |
| 6,157,792 | A | 12/2000 | Mori et al. | 399/24 |
| 6,266,503 | B1 | 7/2001 | Murayama et al. | 399/117 |
| 6,289,189 | B1 | 9/2001 | Numagami et al. | 399/111 |
| 6,298,217 | B1 | 10/2001 | Murayama et al. | 399/358 |
| 6,314,266 | B1 | 11/2001 | Murayama et al. | 399/353 |
| 6,351,620 | B1 | 2/2002 | Miyabe et al. | 399/111 |
| 6,385,416 | B1 | 5/2002 | Horikawa et al. | 399/111 |
| 6,404,996 | B1 | 6/2002 | Mori et al. | 399/24 |
| 6,442,359 | B1 | 8/2002 | Numagami et al. | 399/111 |
| 6,463,233 | B1 | 10/2002 | Kojima et al. | 399/111 |
| 6,577,831 | B1 | 6/2003 | Kojima et al. | 399/111 |
| 6,608,980 | B1 | 8/2003 | Murayama et al. | 399/111 |
| 6,735,406 | B1 | 5/2004 | Noda | 399/111 |
| 6,795,671 | B1 | 9/2004 | Matsuoka | 399/223 |
| 6,834,171 | B1 | 12/2004 | Nittani et al. | 399/103 |
| 6,917,774 | B1 | 7/2005 | Terada et al. | 399/111 |
| 6,934,489 | B1 | 8/2005 | Yokomori et al. | 399/111 |
| 2002/0057924 | A1 | 5/2002 | Ueno et al. | 399/117 |
| 2002/0057928 | A1 | 5/2002 | Yasumoto et al. | 399/167 |
| 2002/0085854 | A1 | 7/2002 | Numagami et al. | 399/90 |

(Continued)

FOREIGN PATENT DOCUMENTS

EP 1 091 266 A2 4/2001

(Continued)

OTHER PUBLICATIONS

Korean Office Action, May 11, 2006.

(Continued)

*Primary Examiner*—Edward Lefkowitz
*Assistant Examiner*—Ryan Gleitz
(74) *Attorney, Agent, or Firm*—Fitzpatrick, Cella, Harper & Scinto

(57) ABSTRACT

A process cartridge is capable of being carried on a movable guide, which is movable relative to a main assembly of an electrophotographic image forming apparatus and which is provided in the main assembly. The movable guide is movable from a receiving position toward a mount position in interrelation with movement of the movable guide. The cartridge includes an electrophotographic photosensitive drum, a process device actable on the drum, a cartridge frame, and first, second, and third positioning portions. The third positioning portion has a first rotation stopper surface for stopping rotation of the cartridge about the first positioning portion and the second positioning portion by abutting the movable guide.

16 Claims, 13 Drawing Sheets

U.S. PATENT DOCUMENTS

| | | | | |
|---|---|---|---|---|
| 2003/0049036 | A1 | 3/2003 | Ueno et al. | 399/25 |
| 2003/0142994 | A1* | 7/2003 | Harada et al. | 399/111 |
| 2003/0156856 | A1 | 8/2003 | Arimitsu et al. | 399/114 |
| 2003/0161654 | A1* | 8/2003 | Yokomori et al. | 399/111 |
| 2003/0185587 | A1 | 10/2003 | Kawai et al. | 399/111 |

FOREIGN PATENT DOCUMENTS

| | | | |
|---|---|---|---|
| EP | 1 207 437 | A2 | 5/2002 |
| EP | 1 241 536 | A2 | 9/2002 |
| EP | 1 336 905 | A2 | 8/2003 |
| JP | 4-90561 | | 3/1992 |
| JP | 04-333066 | A | 11/1992 |
| JP | 2000-321843 | A | 11/2000 |
| JP | 2001-175147 | | 6/2001 |
| JP | 2002-278411 | | 9/2002 |
| JP | 2003-208024 | A | 7/2003 |
| JP | 2003-208074 | | 7/2003 |
| JP | 2003-215876 | A | 7/2003 |
| JP | 2003-241495 | A | 8/2003 |

OTHER PUBLICATIONS

Jun. 27, 2006 Office Action in Japanese Application No. 2003-209843.

* cited by examiner

PROCESS CARTRIDGE, POSITIONING MECHANISM THEREFOR AND ELECTROPHOTOGRAPHIC IMAGE FORMING APPARATUS

BACKGROUND OF THE INVENTION

Field of the Invention

The present invention relates to an electrophotographic image forming apparatus, a process cartridge removably mountable in the main assembly of an electrophotographic image forming apparatus, and a process cartridge positioning mechanism.

Here an electrophotographic image forming apparatus refers to an apparatus which forms images on recording medium (for example recording paper, OHP sheet, etc.) with the use of one of the electrophotographic image forming methods. As for examples of an-electrophotographic image forming apparatus. there are an electrophotographic copying machine, an electrophotographic printer (for example, laser printer, LED printer. etc.). a facsimile machine, a wordprocessor, and an integral combination of two or more of the preceding apparatuses (multifunction printer, etc.).

A process cartridge refers to a cartridge in which a charging means as a processing means, a developing means or a cleaning means as a processing means, and an electrophotographic photosensitive drum are integrally disposed. and which is removably mountable in the main assembly of an electrophotographic image forming apparatus. It also refers to a cartridge in which a minimum of one processing means among a charging means. a developing means, and cleaning means, and an electrophotographic photosensitive drum are integrally disposed, and. which is removably mountable in the main assembly of an electrophotographic image forming apparatus. Further, it means a cartridge in which a minimum of a developing means as a processing means and an electrophotographic photosensitive drum are integrally disposed, and which is removably mountable in the main assembly of an electrophotographic image forming apparatus.

In the field of electrophotographic image forming apparatuses, the process cartridge system has been employed, according to which an electro-photographic photosensitive drum (which hereinafter will be referred to as "photosensitive drum") and a single or plurality of processing means, which act on the photosensitive drum, are integrally disposed in a cartridge removably mountable in the main assembly of an electrophotographic image forming apparatus. Also according to the process cartridge system, an electro-photographic image forming apparatus can be maintained by an operator alone, that is, without relying on service personnel. Thus, the process cartridge system drastically improves an electrophotographic image forming apparatus in operational efficiency. Therefore, the process cartridge system is used in the field of an electrophotographic image forming apparatus.

The process cartridge system is also employed in the field of an electrophotographic color image forming apparatus in the case of an electrophoto-graphic color image forming apparatus a plurality of process cartridges different in development. color are removably mounted in the main assembly of the apparatus, assisting the operator in terms of operational efficiency.

Also in the case of an electrophotographic color image forming apparatus, the plurality of process cartridges are vertically stacked in parallel, reducing thereby the footprint of the apparatus.

In other words, in the case of an electrophotographic color image forming apparatus, the plurality of process cartridges must be mounted in predetermined positions in the main assembly of the apparatus, adding to the number of operations which an operator must carry out.

Therefore, in the case of an electrophoto-graphic color image forming apparatus, it has been desired to further improve the efficiency with which a process cartridge is mounted in the apparatus main assembly.

It has been a common practice to provide the main assembly of an image forming apparatus with a cartridge mounting guide. which is movable relative to tile main assembly, and into which a process cartridge is mounted. After the mounting of the process cartridge into the movable cartridge mounting guide, the guide is moved to carry the process cartridge into the predetermined position in the apparatus main assembly. It has been proposed to employ this cartridge mounting guide in order to improve the efficiency with which a process cartridge is mounted into the apparatus main assembly (for example, Japanese Laid-open Patent Application 4-90561).

According to another proposal (for example, U.S. Pat. No. 6,351,620), a process cartridge is provided with a pair of guides. which are located at the lengthwise ends of the cartridge, one for one. As a process cartridge is mounted into the movable guide of the main assembly of an image forming apparatus, each guide of the process cartridge is seized between a cartridge catching portion and a springy member on the main assembly side, being thereby fixed in position to accurately position the cartridge relative to the apparatus main assembly.

The present invention is the result of the further development of the above described prior art.

SUMMARY OF THE INVENTION

The primary object of the present invention is to provide a combination of a process cartridge a process cartridge mounting mechanism, and an electrophotographic image forming apparatus, which is superior to the combinations in accordance with the prior art in terms of the operational efficiency of the mounting of a process cartridge into the main assembly of an electrophotographic image forming apparatus.

Another object of the present invention is to provide a combination of a process cartridge a process cartridge mounting mechanism and an electrophotographic image forming apparatus, which assures that a process cartridge is accurately mounted into the predetermined position in the main assembly of an electrophotographic image forming apparatus.

Another object of the present invention is to provide a combination of a process cartridge, a process cartridge mounting mechanism, and an electrophotographic image forming apparatus, which regulates the rotation of a process cartridge about first and second cartridge" positioning portions, by the third cartridge positioning portion, in order to assure that a process cartridge is accurately mounted into the predetermined position in the main assembly of an electrophotographic image forming apparatus.

Another object of the present invention is to provide a process cartridge which is mountable in the cartridge mounting guide movable relative to the main assembly of an electrophotographic image forming apparatus and movable from the cartridge mounting position to the image formation position, by the movement of the cartridge mounting guide, and also, comprises:

a first cartridge supporting portion, by which the process cartridge is supported by the movable guide, and which is a part of the bottom surface of one of the lengthwise end portions of the cartridge frame;

a second cartridge supporting portion by which the process cartridge is supported by the movable guide and which is a part of the bottom surface of the other lengthwise end portion of the cartridge frame; and a third cartridge positioning portion, which is located forward of either the first or second cartridge supporting portion, or both in terms of the direction in which the process cartridge is mounted into the apparatus main assembly and which includes a first rotation control surface, with which the process cartridge comes into contact being thereby prevented from rotating further as it is rotated about the axial lines of the first and second positioning portions by the force generated as driving force is transmitted to the process cartridge from the apparatus main assembly, a mechanism for positioning the process cartridge and an electrophotographic image forming apparatus which employs the process cartridge.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiment of the present invention will be described in detail with reference to the appended drawings. Incidentally, the measurements materials, and configurations of the structural components and the positional relationships among the structural components, in this embodiment, are not intended to limit the scope of the present invention. Further once a given component is described, its material, configuration, etc., will be the same throughout this patent application, unless specifically noted.

Also hereinafter, the lengthwise direction of a process cartridge refers to the direction that intersects with (roughly perpendicular to) the direction in which a cartridge is mounted into, or removed from, the main assembly of an image forming apparatus. It also refers to the lengthwise direction of a photosensitive drum. The top and bottom surfaces of a cartridge refers to the surfaces of a cartridge: which will be at the top and bottom of the process cartridge, respectively, after the accurate positioning of the cartridge in the main assembly of an image forming apparatus.

[Description of General Structure of Electrophotographic Color Image Forming Apparatus]

First, the general structure of the electrophotographic color image forming apparatus will be described with reference to FIG. 2, which is a sectional view of a color laser printer, that is, one of the embodiments of the present invention in the form of an electrophotographic image forming apparatus employing an electrophotographic process, showing the general structure thereof.

Figure 2:
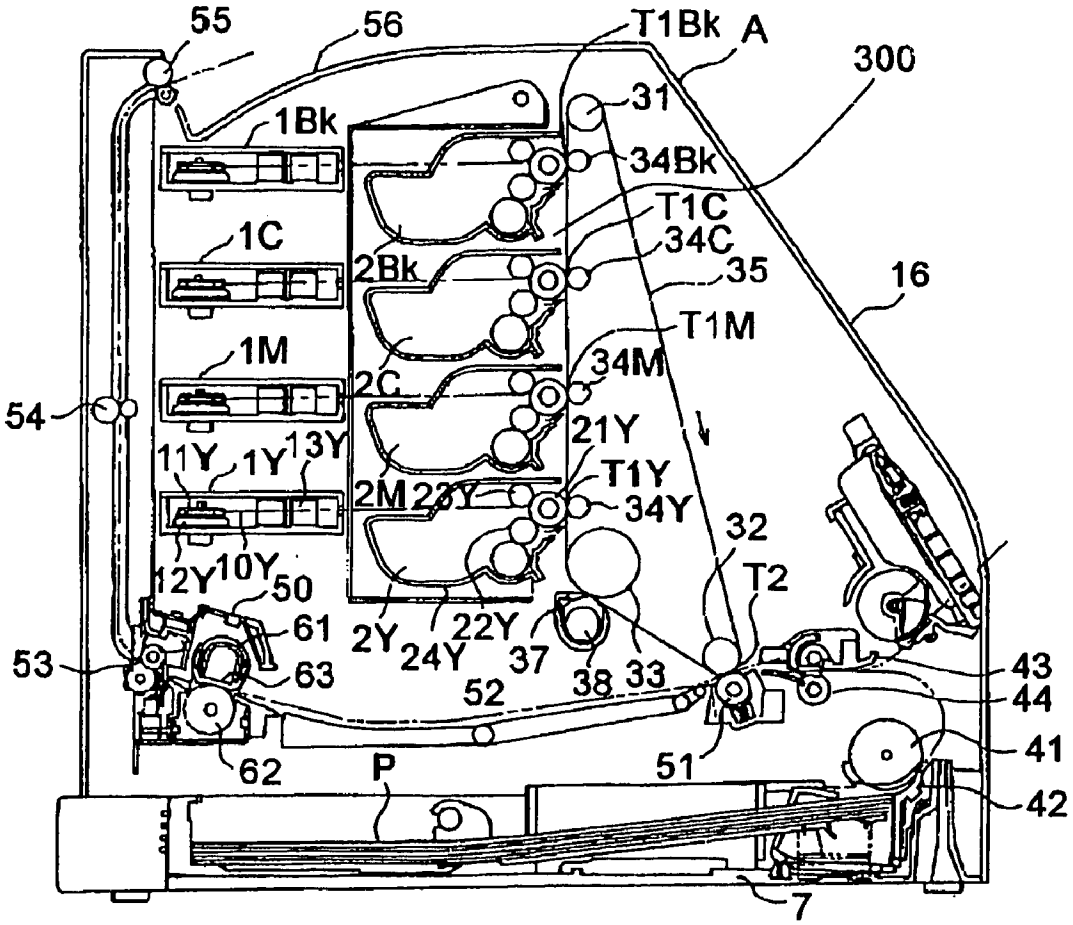
FIG. 2 is a schematic sectional view of a color laser printer which is one of the embodiments of the present invention in the form of an electrophotographic image forming apparatus.

As shown in FIG. 2, the color laser printer (which hereinafter will be referred to as "printer") is a four-drum type (inline type) printer, which includes: four process cartridges 2 (2Y, 2M, 2C, and 2Bk); an intermediary transfer member (medium) 35; a fixing station 50 for fixing a color image transferred onto recording medium P (for example, recording paper, OHP sheet, etc.) to the recording medium P; and multiple pairs of discharge rollers 53, 54, and 56 for discharging the recording medium P onto a delivery tray 56 on top of the apparatus main assembly.

The four process cartridges 2 (2Y, 2M, 2C, and 2Bk) are mounted in the main assembly of the color printer A, being vertically stacked.

The cartridge 2Y stores developer of yellow color, and forms an image of the yellow developer. The cartridge 2M stores developer of magenta color and forms an image of the magenta developer. The cartridge 2C stores developer of cyan color, and forms an image of the cyan developer. The cartridge 2Bk stores developer of black color, and forms an image of the black developer.

The intermediary transfer member 35 is a member onto which images formed from developers in process cartridges 2 are temporarily transferred in layers, forming an image (color image) made of the developers different in color, and from which the image (color image) is transferred onto a recording medium P.

The four cartridges 2 can be individually mounted into, or removed from, the main assembly A of the printer.

Next, referring to FIG. 2, the various portions of the image forming apparatus will be described structurally in a logical order. Incidentally, where all the cartridges are the same regarding a given structural feature, only the cartridge 2Y will be described regarding this structural feature, and the other process cartridges will not be given reference symbols, and will not be described regarding this structural feature.

[Photosensitive Drum]

The photosensitive drum 21 includes an aluminum cylinder, and a layer of organic photosensitive substance coated on the peripheral surface of the aluminum cylinder. It is rotatably supported by the drum frame 24. At the back side (FIG. 2) of the photosensitive drum 21, the driving force from a cartridge driving motor (unshown) is transmitted to the lengthwise end of the photosensitive drum 21, whereby the photosensitive drum 21 is rotated in the counterclockwise direction (FIG. 7) indicated by an arrow mark in the drawing in synchronism with an image formation.

[Charging Means]

A charging means employs a contact charging method. It has an electrically conductive roller (charge roller) 23 (23Y), which is placed in contact with the peripheral surface of the photosensitive drum 21. As voltage is applied to the charge roller 23, the peripheral surface of the photosensitive drum 21 is uniformly charged.

[Exposing Means]

The photosensitive drum 21 is exposed by a scanner portion 1 (1Y). More specifically, as an image formation signal is given to a laser diode (unshown), the laser diode emits a beam of image formation light 10 (10Y), in response to the image formation signal, toward a polygon mirror 11 (11Y).

The polygon mirror 11 is being rotated at a high speed by a scanner motor 12 (12Y). The beam of image formation light 10 is reflected by the mirror 1, and is guided through a focal lens 13 (13Y) to the peripheral surface of the photosensitive drum 21, which also is rotated at a constant peripheral velocity, selectively exposing numerous points on the peripheral surface of the photosensitive drum 21. As a result, an electrophotographic latent image is formed on the peripheral surface of the photosensitive drum 21.

[Developing Means]

The developing means develops the electrostatic latent image into a visible image. Thus, it is provided with a development unit 2*b* (FIG. 7) which makes it possible for the latent image to be developed with developer. The development unit 2*b* has a development roller 22 (22Y), which is disposed in the position in which it is rotatable in contact with the photosensitive drum 21. It uses developer to develop the latent image on the photosensitive drum 21.

[Intermediary Transfer Member]

The intermediary transfer member 35 is a member onto which multiple images formed from developers on the photosensitive drums 21, by the developer units 2*b*, one for one, are transferred in layers during color image formation. The intermediary transfer member 35 is rotationally driven in the clockwise direction (FIG. 2) at the same peripheral velocity as that of the photosensitive drum 21.

After being formed on the photosensitive drums 21, the images formed from developers on the photosensitive drums 21 are transferred in layers onto the intermediary transfer member 35 by the primary transfer rollers 34 (34Y, 34M, 34C, and 34Bk), one for one, in the primary transfer stations T1 (T1Y, TIM, TIC, and T1Bk). Each transfer roller 34 is disposed so that it is kept pressed upon the corresponding photosensitive drum 21, with the intermediary transfer member 35 sandwiched between the transfer roller 34 and photosensitive drum 21.

After the multiple images formed of developers are transferred in layers onto the intermediary transfer member 35, the recording medium P is sandwiched between the intermediary transfer member 35 and secondary transfer roller 51, and is conveyed by them. As a result, the color images formed of developers, on the intermediary transfer member 35, are transferred all at once onto the recording medium P.

The intermediary transfer member (intermediary transfer belt) 35 in this embodiment is a seamless resin belt with a circumferential dimension of roughly 620 mm. It is stretched around a driving roller 31, intermediary transfer member backing roller 32, and tension roller 33, being thereby supported by them. The tension roller 33 is kept pressured outward of the loop, which the intermediary transfer member 35 forms, by the pressure applied to the lengthwise ends of the roller 33. With the provision of this structural arrangement, should the circumferential dimension of the intermediary transfer member (belt) 35 change due to the changes in the internal temperature and/or humidity of the apparatus main assembly A, the change is absorbed by the structural arrangement.

Further, the intermediary transfer member 35 is pivotally held to the main assembly A of the apparatus (printer), being allowed to pivotally move about the rotational axis of the driving roller 31. The driving force from a motor (unshown) is transmitted to the back end (FIG. 2) of the driving roller 31, rotating the intermediary transfer member 35 in the clockwise direction (FIG. 2) in synchronism with image formation.

[Feeding Station]

The feeding station is a station for conveying recording mediums P to the cartridges 2 in the main assembly A of the printer. It includes a cassette 7 capable of containing multiple recording media P, a feed roller 41, a separation pad 42, a conveyance guide 43 and a pair of registration rollers 44, etc.

During image formation, the roller 41 is rotationally driven in synchronism with image formation, whereby the recording media P in the cassette 7 are fed one by one out of the cassette 7, and guided by the guide 43 to the pair of registration rollers 44, which carries out, in a predetermined sequence, the non-rotational process for keeping the recording medium P on standby and the rotational process for conveying the recording medium P toward the intermediary transfer member 35, in order to make the recording medium P align with the images on the intermediary transfer member 35 during the subsequent process, that is, the image transfer process.

[Transfer Station]

The transfer station has a secondary transfer roller 51, which is rotationally driven, and is virtually vertically movable (FIG. 2). In synchronism with the arrival of the color images at the transfer station, the transfer roller 51 is pressed against the intermediary transfer member 35 by a cam (unshown) onto the recording medium P with the application of a predetermined amount of pressure, with the recording medium P nipped between the intermediary transfer member 35 and transfer roller 51. During this process, bias is applied to the transfer roller 51. As a result, the images formed of developers, on the intermediary transfer member 35 are transferred onto the recording medium P. Incidentally, the intermediary transfer member 35 and transfer roller 51 are driven independently of each other. Therefore, after the transfer process, the recording medium P, which has been kept sandwiched by the intermediary transfer member 35 and transfer roller 51 during the transfer process, is conveyed leftward (FIG. 2), reaching a fixing device 50.

[Fixing Station]

In the fixing station, the color images formed of developers on the recording medium Pare fixed to the recording medium P by the fixing device 50, which comprises a film guide unit 61 and a pressure roller 62. The film guide unit 61 contains a ceramic heater 63 for heating the recording medium P. The pressure roller 62 is for pressing the recording medium P against the film guide unit 61. With the provision of this structural arrangement, the recording medium P is subjected to heat and pressure, whereby the color images formed of developers are fixed to the recording medium P.

[Image Forming Operation]

Next, the operation for forming an image with the use of the apparatus structured as described above will be described.

First, the feed roller 41 shown in FIG. 2 is rotated, conveying thereby one of the recording media P in the cassette 1 to the pair of registration rollers 44.

Meanwhile, the photosensitive drum 21 and intermediary transfer member 35 are rotated independently of each other, in the direction indicated by the arrow (FIG. 2) at a predetermined peripheral velocity (which hereinafter will be referred to as the process speed).

After being charged by the charge roller 23 across its peripheral surface, the photosensitive drum 21 is exposed to the beam of laser light 10 (image formation light). As a result, an electrostatic latent image is formed on the peripheral surface of the photosensitive drum 21. Since the image forming operation is the same for all color components, the image formation operation for the yellow color component will be described here.

(Formation of Yellow Image)

A latent image corresponding to the yellow color component of a target image is formed by exposing the peripheral surface of the photosensitive drum 21Y to the beam of laser light 10Y, corresponding to the yellow color component of the target image, projected from the scanner portion 1Y. In synchronism with the formation of this latent image, the yellow development roller 22Y is rotated while voltage, the polarity of which is the same as that of the photosensitive drum 21Y, is applied to the yellow development roller 22Y in order to adhere yellow developer to the latent image on the photosensitive drum 21Y, that is, in order to develop the latent image with the yellow developer. The developed latent image, that is, an image formed of yellow developer, is transferred (primary transfer) onto the peripheral surface of the intermediary transfer member 35, in the transfer station T1Y.

Then, the processes for forming a latent image and developing the latent image, similar to those described above, are sequentially carried out for the magenta, cyan, and black color components. The formed developer images are transferred onto the intermediary transfer member 35, in the primary transfer stations T1M, T1C, and T1Bk, respectively. As a result, a full-color image composed of four developers, that is, the yellow, magenta, cyan, and black developers, are formed on the peripheral surface of the intermediary transfer member 35.

Incidentally, prior to the completion of the transfer of the image formed of black developer onto the intermediary transfer member 35, the recording medium P, which has been kept on standby by the above described pair of registration rollers 44, is released by the pair of registration rollers 44 for further conveyance.

Except for the period in which the four color images are transferred onto the intermediary transfer member 35, the transfer roller 51 is kept at the bottom position, away from the intermediary transfer member 35. However, immediately prior to the transfer of the four color images onto the intermediary transfer member 35, the transfer roller 51 is moved upward by a cam (unshown) in order to keep the recording medium P pressed against the intermediary transfer member 35 by the transfer roller 51, in the second transfer station T2, while the four images are transferred. Further, during the secondary transfer of the four color images, bias opposite in polarity to the developers is continuously applied to the transfer roller 51. As a result, the four color images, which make up a full-color image, on the intermediary transfer member 35, are transferred all at once onto the recording medium P.

Thereafter, the recording medium P is separated from the intermediary transfer member 35, and is conveyed to the fixing device 50, in which the images formed of the developers are fixed. Then, the recording medium P is discharged onto the delivery tray 56 on top of the main assembly of the printer, by the three pairs of discharge rollers, ending the operation for forming a full-color image on one of the recording media P.

[Method for Mounting Process Cartridge]

Figure 1:
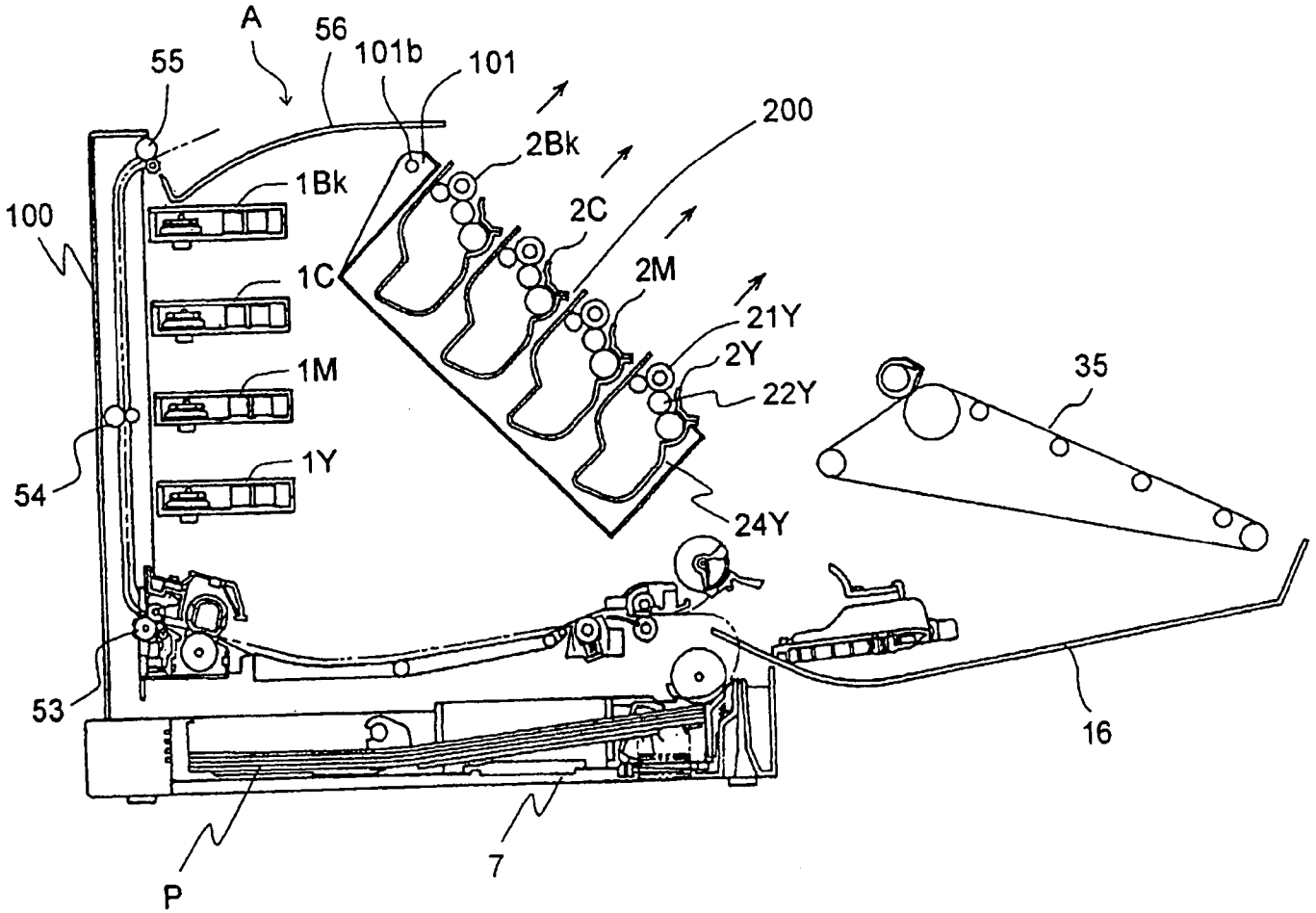
FIG. 1 is a schematic sectional view of an image forming apparatus in accordance with the present invention. showing how the door of the apparatus is opened or closed.

Next, the combination of the process cartridge 2, a process cartridge mounting mechanism, and an electrophotographic image forming apparatus, in an preferred embodiment of the present invention will be described. FIG. 1 is a schematic sectional view of the printer A, that is, one of the embodiments of the present invention in the form of an image forming apparatus, with its main door open.

As shown in FIG. 1, the door 16 of the main assembly 100 of the image forming apparatus is pivotally movable relative to the main assembly 100 about the rotational axis located at the bottom front of the image forming apparatus (printer) A. The aforementioned intermediary transfer member 35 is attached to the door 16. Thus, as the door 16 is opened, it becomes possible for an operator to access the process cartridges 2 (2Y, 2M, 2C, and 2Bk).

The door 16 is to be opened or closed when necessary to mount a single cartridge or multiple cartridges 2 into the apparatus main assembly A, or to remove a single cartridge or multiple cartridges 2 from the apparatus main assembly A.

The movable guide 101 holds together multiple cartridges 2 (2Y, 2M, 2C, and 2Bk). The pivots 101*a-b* and 101*b-b* (FIG. 3) are located at the top end portion of the apparatus main assembly A, and are connected to the door 16 with a set of mechanical linkages (which will be described later). With the provision of this structural arrangement, as the door 16 is opened, the movable guide 101 is pivoted frontward of the apparatus main assembly 100 about the pivots 101*a-b* and 101*b-b*, and therefore, the cartridges 2 supported by the movable guide 101 are also moved frontward of the apparatus main assembly 100.

In this embodiment, the angle by which the movable guide 101 is pivotally moved by the opening of the door 16 is roughly 45°.

With the movable guide 101 tilted as described above, an operator can easily mount cartridges 2 into, or take them out of, the movable guide 101, since there is no obstruction in the direction indicated by arrow marks in the drawing.

Next, the mounting of the process cartridges 2 into the apparatus main assembly 100, and the removing of the process cartridges 2 from the apparatus main assembly 100, will be described.

Figure 3:
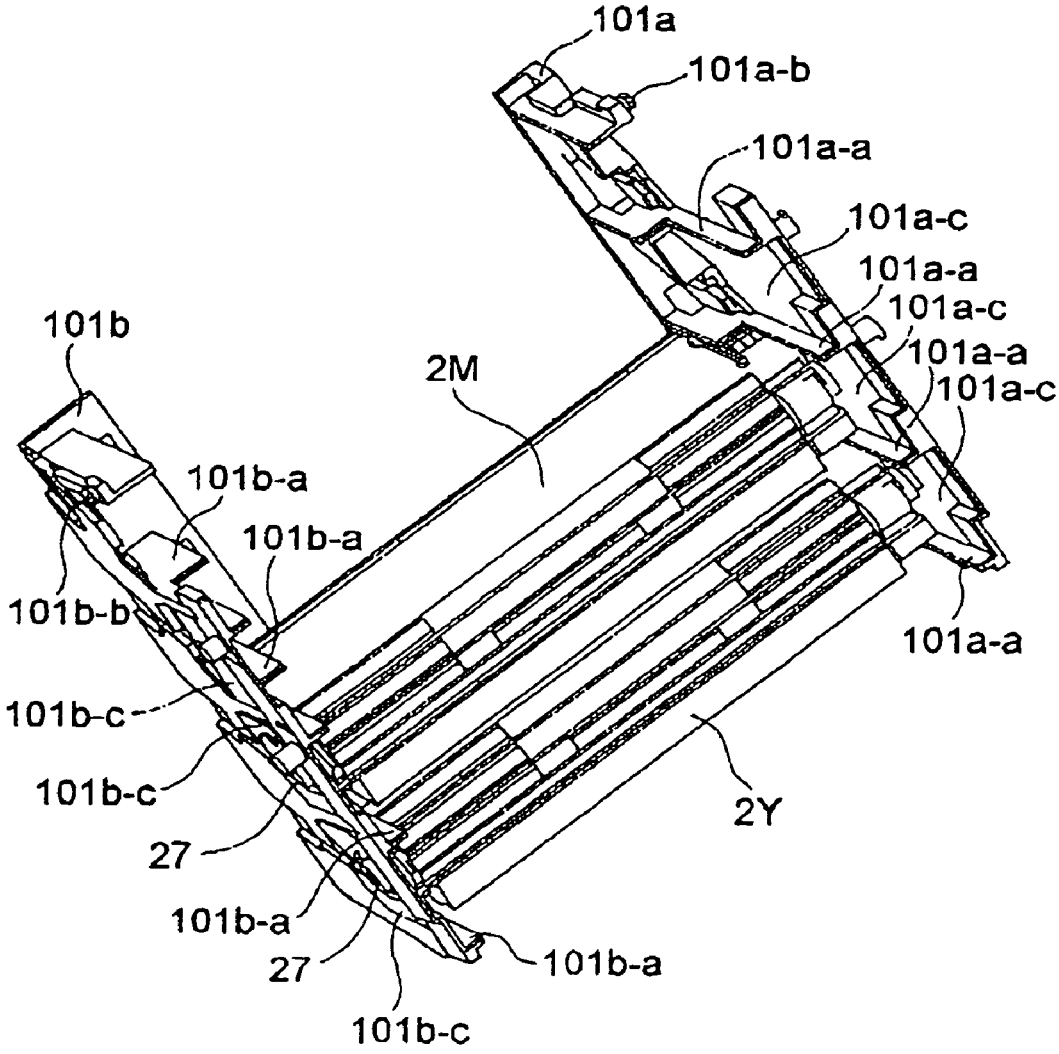
FIG. 3 is a schematic perspective view of the movable guide and the process cartridges in the movable guide in a preferred embodiment of the present invention. showing how the process cartridges are held by the movable guide.

FIG. 3 is a perspective view of the movable guide 101, and the cartridges 2 supported by the movable guide 101. For the sake of descriptive convenience, the process cartridges 2Bk and 2C are not illustrated in the drawing.

The movable guide 101 is provided with right and left plates 101*a* and 101*b*. The right plate 101*a* supports the right end of each of the cartridges 2Y, 2M, 2C, and 2Bk, and the left plate 101*b* supports the left end of each of the cartridges 2Y, 2M, 2C, and 2Bk. In this embodiment, the right and left plates 101*a* and 101*b* of the movable guide 101 are separately manufactured for cost saving. However, the movable guide 101 may be manufactured as a single-piece component, or in multiple pieces which are assembled into the movable guide 101.

Also in this embodiment, the right and left plates 101*a* and 101*b* of the movable guide 101 are connected with a connective member (which will be described later), so that the right and left plates 101*a* and 101*b* remain synchronized in pivotal movement phase, and also, so that the movable guide 101 in this embodiment functions exactly the same as a single-piece movable guide.

The right and left plates 101*a* and 101*b* are provided with guiding ribs 101*a-a* and 101*b-a*, respectively, which support the cartridge 2 from underneath so that the cartridge 2 can be smoothly inserted between the right and left plates 101*a* and 101*b*.

The right and left plates 101*a* and 101*b* are also provided with the pivots 101*a-b* and 101*b-b*, respectively, about which the movable guide 101, in which multiple process cartridges 2 are stacked together, is pivotally movable.

The right plate 101*a* is provided with openings 101*a-c*, preventing thereby right plate 101*a* from interfering with the first and second driving force transmission portions 78 and 79 of each process cartridge 2, through which the cartridge 2 receives driving force from the main assembly 100. On the other hand, the left plate 101*b* is provided with openings 101*b-c*, preventing thereby the left plate 101*b* from interfering with the cartridge positioning bearing 27 of each cartridge 2.

Further, the two plates 101*a* and 101*b* are provided with two bosses by which the plates are connected to the mechanical linkage, which will be described later.

Next, the connection of the movable guide 101 to the mechanical linkage, and the operational movement the movable guide 101, will be described.

Figure 4:
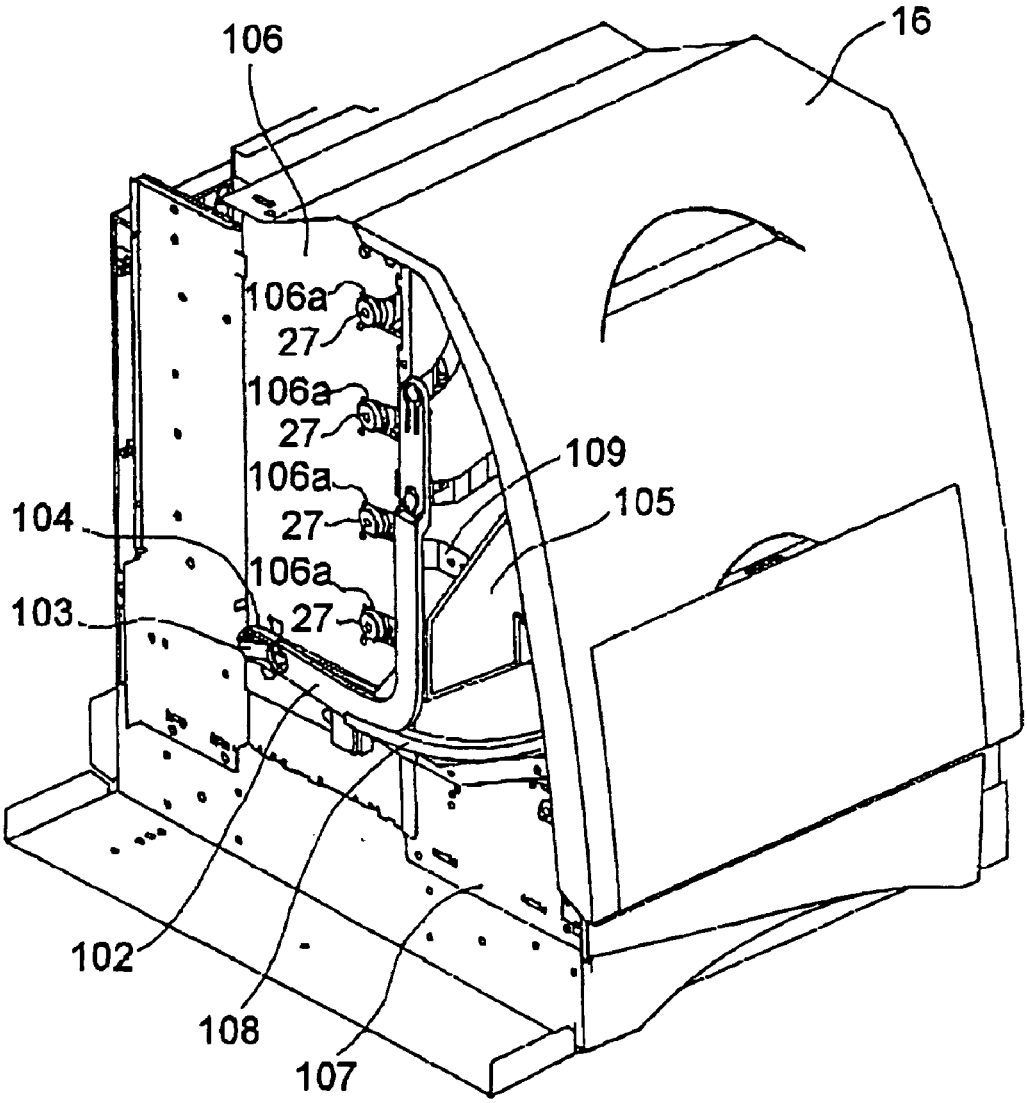
FIG. 4 is a schematic perspective view of the image forming apparatus in the preferred embodiment of the present invention. with one of its side covers removed, showing the mechanical linkage in the state in which the apparatus is in the image forming action.
Figure 5:
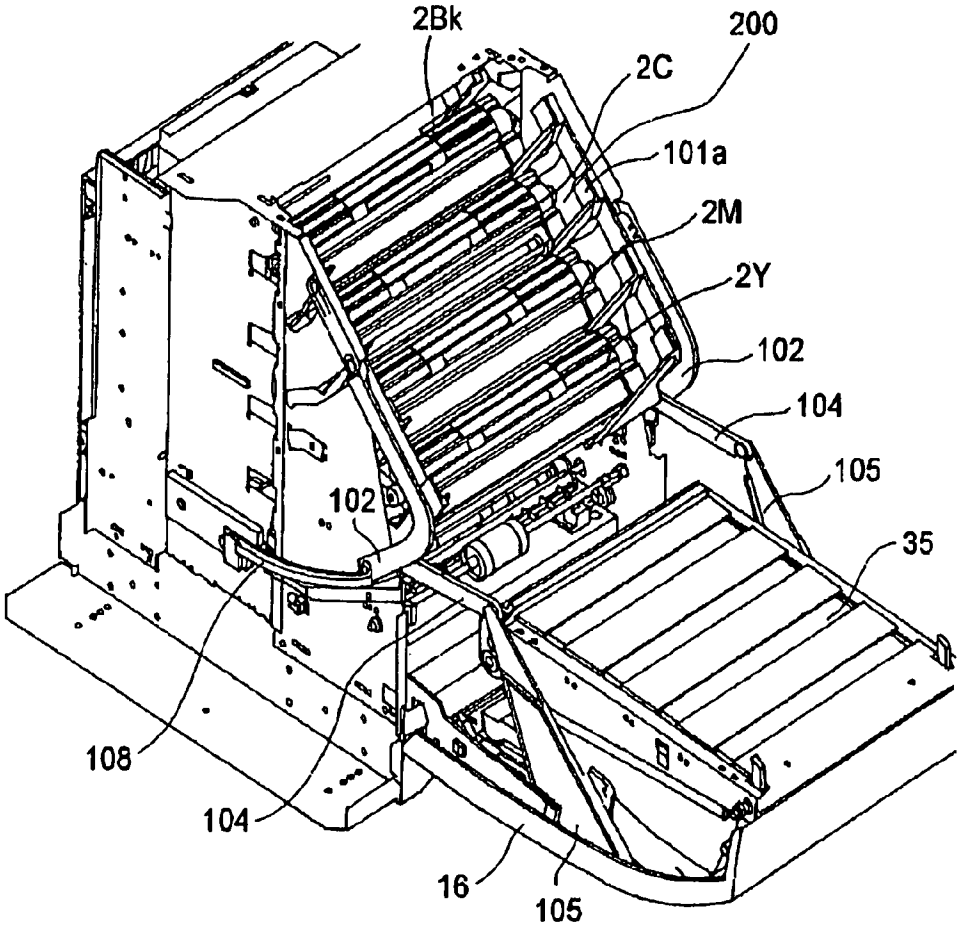
FIG. 5 is a schematic perspective view of the image forming apparatus in the preferred embodiment of the present invention with its main door opened showing the mechanical linkage.
Figure 6:
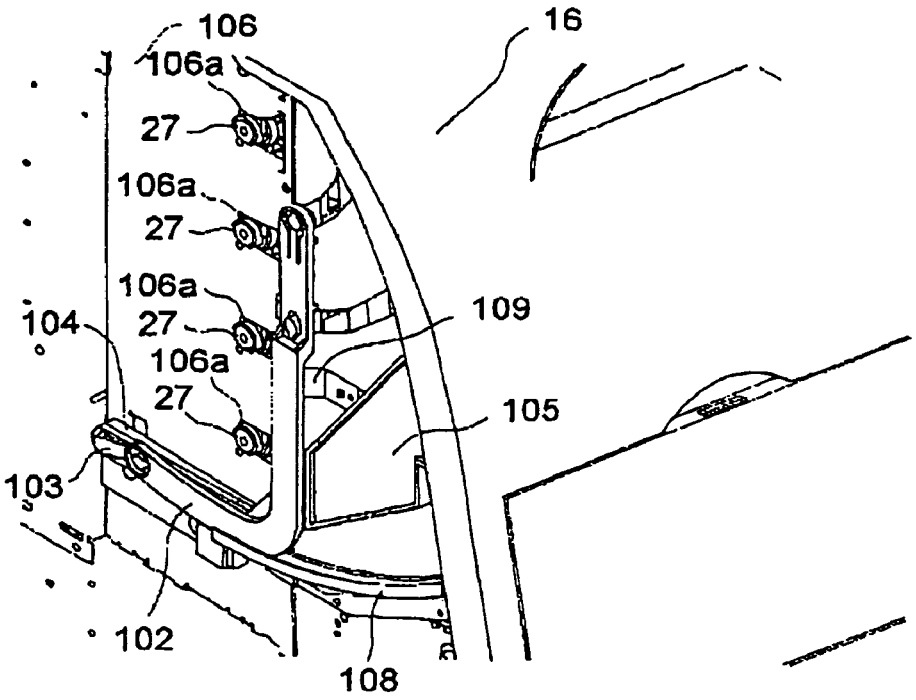
FIG. 6 is an enlarged schematic perspective view of the mechanical linkage, and its adjacencies, in the state in which the apparatus is in the image forming action.

FIGS. 4, 5, and 6 are schematic perspective internal views of the image forming apparatus, showing the set of mechanical linkages, which connects the right and left plates 101*a* and 101*b*. FIG. 4 is a schematic perspective view of the mechanical linkage in the state in which the image forming apparatus is in the image forming action, and FIG. 5 is a schematic perspective internal view of the image forming apparatus in this embodiment, showing the mechanical linkage in the state in which the door 16 is open. FIG. 6 is an enlarged schematic perspective view of the mechanical linkage shown in FIG. 4.

First, referring to FIGS. 4 and 6, the mechanical linkage in the state in which the door 16 is closed will be described. In this state, the movable guide 101 is kept inside the apparatus main assembly 100 by the mechanical linkage, because a retaining spring 109 is keeping the mechanical linkage in the state in which the door 16 is closed. The mechanical linkage includes: a door connection plate 105;

an intermediary connective rod 104; a rotational rod 103; and a connective rod 102 connected to the movable guide 101.

In this state, each of the cartridges 2 in the movable guide 101 is kept pressed by a spring (unshown) so that each of the bearings 27 and 28 extending from the lengthwise ends of the cartridge 2, one for one, remains in contact with the wall of the cartridge positioning slot 106*a* of the corresponding side wall 106 of the frame of the apparatus main assembly 100.

As will be evident from the above description, it is not the movable guide 101, but the side walls 106 of the frame of the main assembly 100, that accurately position the cartridges 2. With the provision of the above described structural arrangement, the movable guide 101 functions simply as a vehicle for carrying the cartridge 2 into the immediate adjacencies of the final position for the cartridge 2 in the apparatus main assembly 100 when mounting the process cartridge 2 into the apparatus main assembly 100. Therefore, it is unnecessary for an operator to become excessively concerned with the positioning of the cartridge 2 relative to the movable guide 101 when mounting the cartridge 2 into the movable guide 101. In other words, when mounting the process cartridge into the movable guide 101, it is unnecessary for an operator to confirm whether or not the cartridge 2 has been exactly positioned mounted in the movable guide 101.

Therefore, the efficiency with which the cartridge 2 is mounted into the apparatus main assembly 100 is improved.

Next, referring to FIG. 5, the state of the mechanical linkage, in which the door 16 is fully open, will be described. As the door 16 is opened, the aforementioned connective plate 105, intermediary rod 104, rotational rod 103, and connective rod 102, which are moved by the movements the door 16, are moved into their positions corresponding to the movable guide position 200 in which the cartridges are to be mounted into the movable guide 101, and which is roughly 45° orbitally outward of the apparatus main assembly 100 from the movable guide position in which images are formed. In other words, as the door 16 is completely opened, it becomes easier for an operator to access the cartridge slots in the movable guide 101, making it thereby easier for the operator to mount the cartridges 2 into the apparatus main assembly 100 or remove them therefrom.

The above described cartridge mounting position 200 for the movable guide 101 is on the front side of the apparatus main assembly 100, that is, the side where the door 16 is present, whereas the movable guide position in which images are formed (which hereinafter will be referred to as "image formation position 300") is the position in the apparatus main assembly 100, into which the movable guide 101 is moved by the closing movement of the door 16, in order to accurately position the cartridges 2 relative to the apparatus main assembly 100, for image formation.

In other words, it is the position in which the bearings 27 and 28 are accurately positioned by the walls of the positioning slots 106*a* and 106*b* relative to the apparatus main assembly 100. Incidentally, in this embodiment, the position of the cartridge 2 to which driving force is being transmitted from the apparatus main assembly 100 is slightly different from the predetermined final position in the apparatus main assembly 100, into which the cartridge 2 is moved by the closing of the door 16.

[Process Cartridge]

Figure 7:
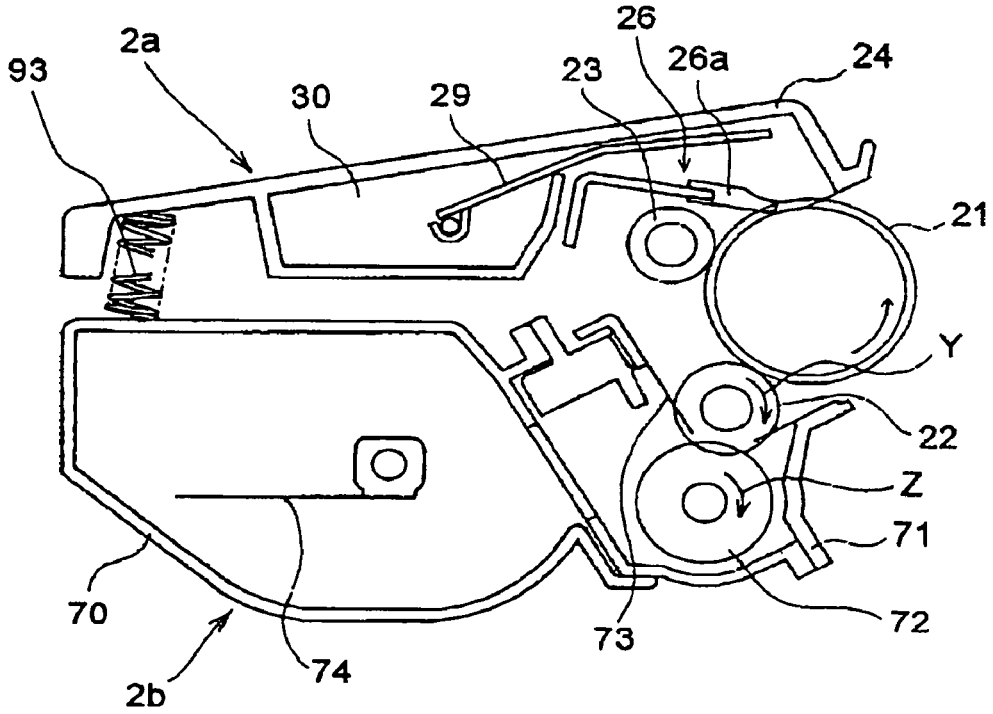
FIG. 7 is a schematic sectional view of the process cartridge in the preferred embodiment of the present invention.
Figure 8:
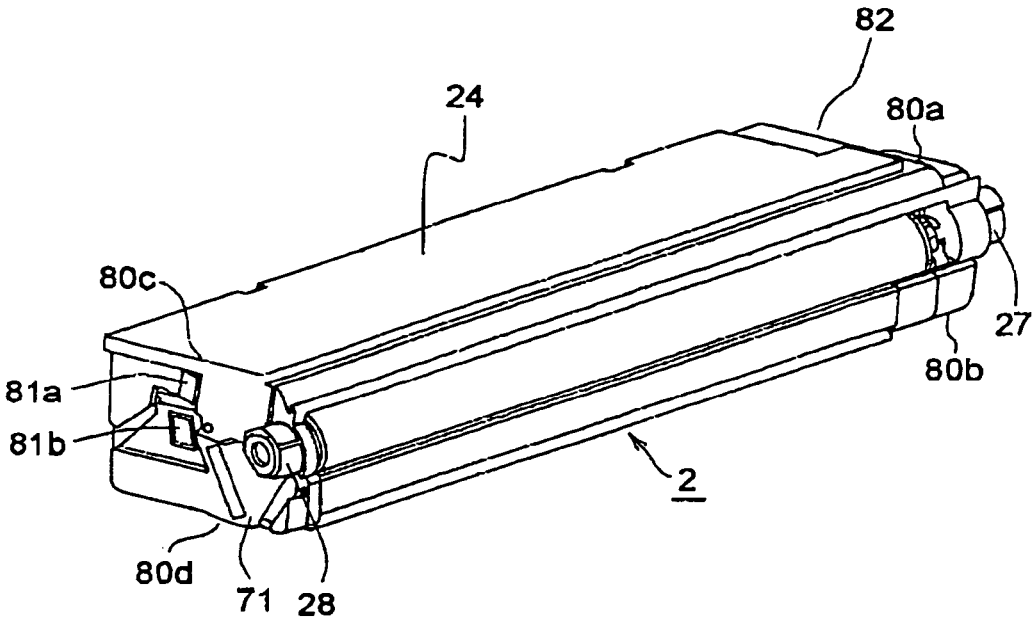
FIG. 8 is a schematic perspective view of the process cartridge in the preferred embodiment of the present invention.
Figure 9:
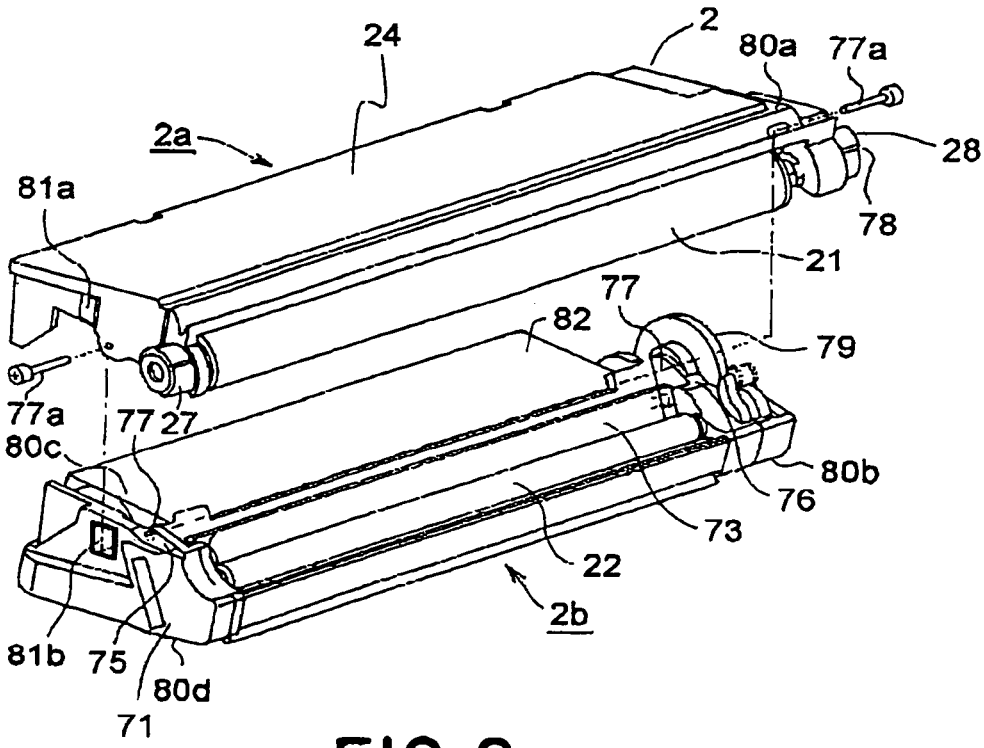
FIG. 9 is also a schematic perspective view of the process cartridge in the preferred embodiment of the present invention.

Next, referring to FIGS. 7, 8, and 9, the cartridge 2 in the preferred embodiment of the present invention will be described. FIG. 7 is a schematic sectional view of the cartridge 2, and FIGS. 8 and 9 are perspective views of the cartridge 2. Incidentally, the yellow, magenta, cyan, and black process cartridges are identical in structure.

The cartridge 2 essentially has two units: a drum unit 2*a* and a development unit 2*b*. The drum unit 2*a* supports the photosensitive drum 21, charge roller 23, and cleaning means 26, whereas the development unit 2*b* supports the developing means for developing an electrostatic latent image formed on the photosensitive drum 21.

The units 2*a* and 2*b* are connected to each other so that they can be pivotally moved relative to each other.

The drum unit 2*a* holds the photosensitive drum 21, with the photosensitive drum 21 being rotatably supported by the bearings 27 and 28 attached to the drum frame 24. The drum frame 24 holds the charge roller 23, as a processing means, for uniformly charging the peripheral surface of the photosensitive drum 21, and a cleaning blade 26*a*, as a processing means, for removing the developer particles remaining on the peripheral surface of the photosensitive drum 21.

After the residual toner particles, that is, the toner particles remaining on the peripheral surface of the photosensitive drum 21, are removed therefrom by the cleaning blade 26*a*, they are sent by a toner conveying mechanism 29 into the toner chamber 30 for the removed toner, which is in the rear portion of the drum frame 24. This toner chamber 30 is an integral part of the drum unit 2*a*.

The development unit 2*b* comprises: a development roller 22 as a processing means which is rotated in the direction indicated by an arrow mark Y by the contact between the development unit 2*b* and photosensitive drum 21; a developer container 70 in which developer is held; and a development frame 71 which supports the development roller 22, and which comprises the developer container 70. The development roller 22 is rotatably supported by the development frame 71, with the interposition of bearings. Further, the development frame 71 internally holds a developer supply roller 72 and a development blade 73. The developer supply roller 72 is rotated by its contact with the development roller 22. The development frame 71 also internally holds a stirring member 74, which is in the developer container 70 and conveys the developer in the developer container 70 to the developer supply roller 72 while stirring it.

The development unit 2*b* is connected to the drum unit 2*a*, being enabled to be pivotally moved relative to the drum unit 2*a*. More specifically, the development unit 2*b* is provided with a pair of bearings 75 and 76, which are located at the lengthwise ends of the development unit 2*b*, one for one, and a pair of pins 77*a* are inserted into the holes 77 of the bearings 75 and 76, one for one, making it possible for the entirety of the development unit 2*b* to be pivotally moved relative to the drum unit 2*a* about the axial lines of the holes 77 (pins 77*a*). In other words, the development unit 2*b* is suspended from the drum unit 2*a*. With the provision of this structural arrangement, the development roller 22 is kept in contact with the photosensitive drum 21 by the rotational moment of the development unit 2*b* about the axial lines of the holes 77 (pins 77*a*). Further, there is disposed a pair of compression springs 93 between the development units 2*b* and drum unit 2*a*, assuring by its resiliency that the development roller 22 is kept pressed upon the photosensitive drum 21.

"Cartridge frame" is the term for the combination of the drum frame 24 and development frame 71.

In the development process, developer is conveyed by the stirring member 74 to the developer supply roller 72, which is being rotated (in arrow Z direction). Then, as the developer is conveyed to the developer supply roller 72, it is coated on the development roller 22, which is being rotated (in arrow Y direction), because the peripheral surface of the developer supply roller 72 rubs against the peripheral surface of the development roller 22; in other words, the developer is borne on the peripheral surface of the development roller 22. The developer borne on the peripheral surface of the development roller 22 reaches the development blade 73 due to the subsequent rotation of the development roller 22, and is regulated by the development blade 73, while being given a predetermined amount of electric charge. As a result, a development layer with a predetermined thickness is formed on the peripheral surface of the development roller 22.

The further rotation of the development roller 22 brings the uniform portion of the developer layer on the development roller 22 to the development station, that is, the contact area between the photosensitive drum 21 and development roller 22, in which the latent image on the peripheral surface of the photosensitive drum 21 is developed by the DC voltage (development bias) applied to the development roller 22 from a power source (unshown). The developer particles remaining on the peripheral surface of the development roller 22 after the development are stripped from the peripheral surface of the development roller 22, returning therefore into the developer container 70, in which they are mixed with the developer in the container 70 by the stirring member 74.

(Structure for Positioning Process Cartridge)

Figure 10:
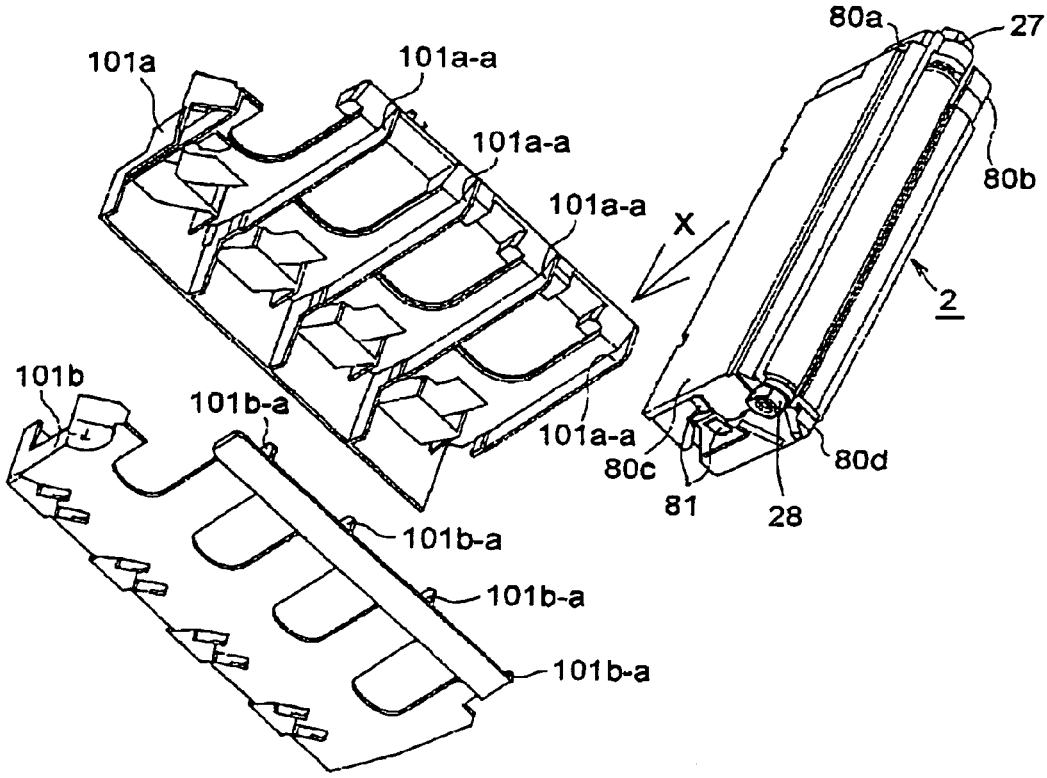
FIG. 10 is a schematic view of the movable guide and a process cartridge in the preferred embodiment of the present invention, showing how the process cartridge is mounted into the movable guide.
Figure 11:
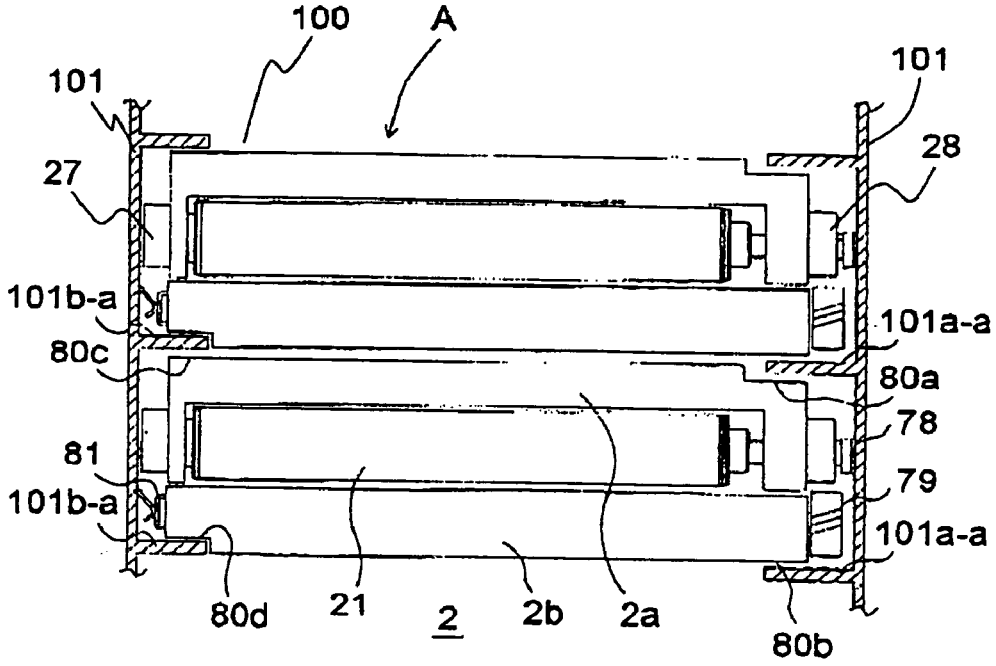
FIG. 11 is a schematic vertical sectional view of the movable guide of the image forming apparatus, holding a pair of process cartridges, in a plane parallel to the front panel of the apparatus, in the preferred embodiment of the present invention.
Figure 12:
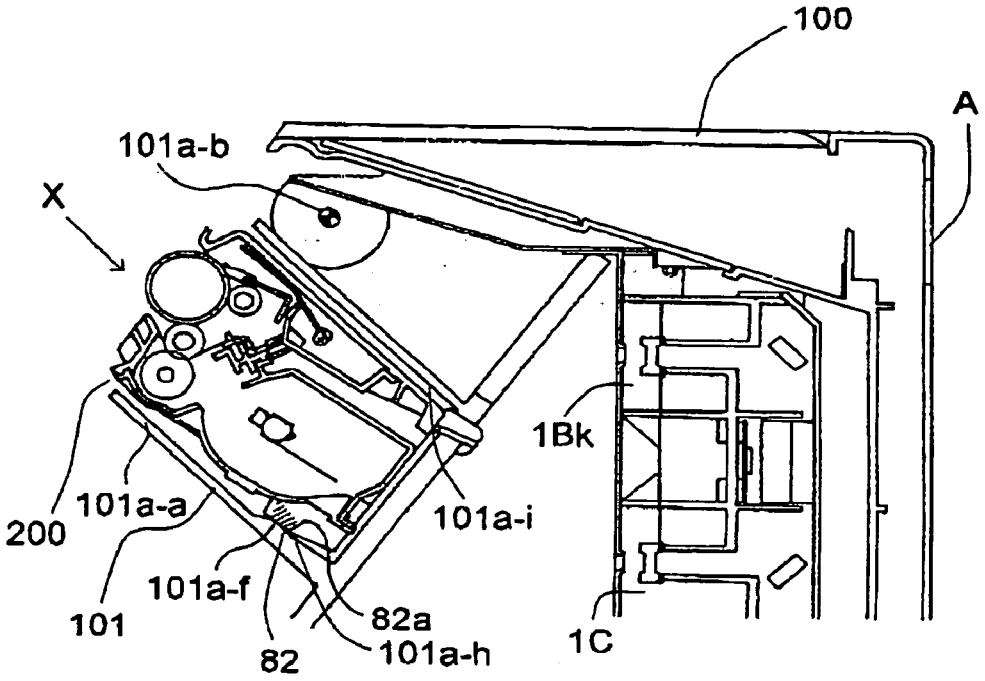
FIG. 12 is a schematic vertical sectional view of the process cartridge in the movable guide of the image forming apparatus, in the preferred embodiment of the present invention, in a plane parallel to the side panel of the apparatus, showing the process cartridge positioning mechanism in the position in which the cartridge is mounted into the movable guide.
Figure 13:
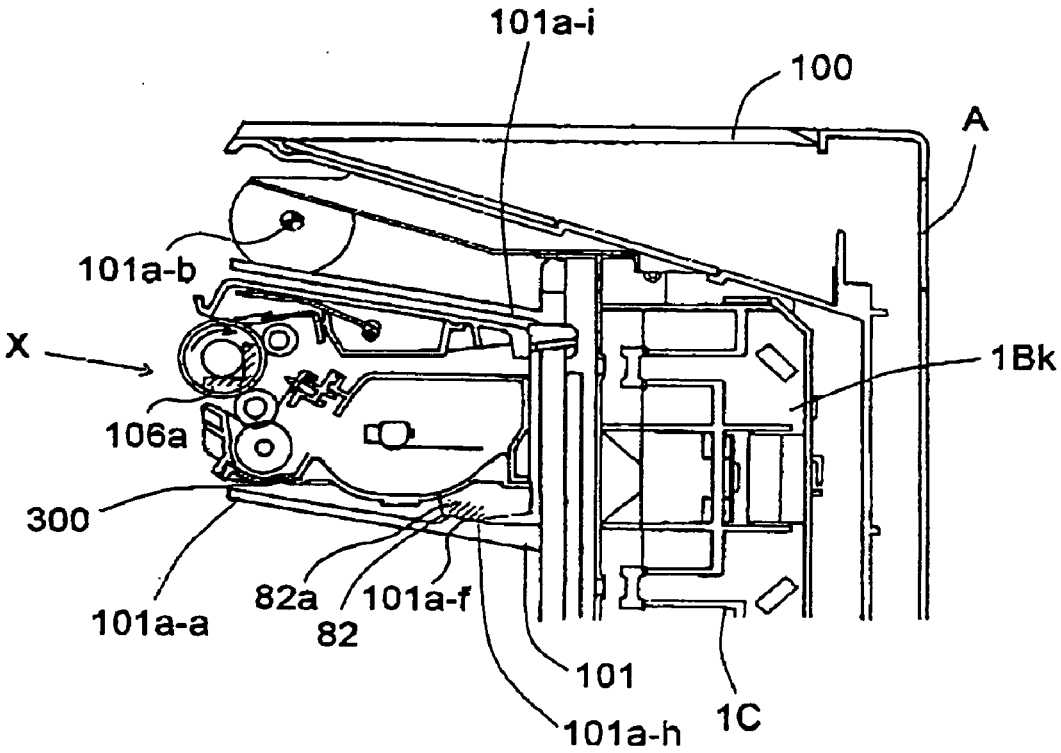
FIG. 13 is a schematic vertical sectional view of the process cartridge in the movable guide of the image forming apparatus, in the preferred embodiment of the present invention, in a plane parallel to the side panel of the apparatus, showing the process cartridge in the state in which it has been accurately positioned relative to the apparatus main assembly by the closing of the main door.

Next, referring to FIGS. 10–13, the structure, in this embodiment, for mounting, removing, and positioning a process cartridge will be described. FIG. 10 is a perspective view of the movable guide 101 and a process cartridge 2, showing how the process cartridge is mounted into the movable guide 101, and FIG. 11 is a sectional view of the movable guide 101 in this embodiment, showing the configuration thereof. FIG. 12 is a vertical sectional view, in a plane parallel to the cartridge mounting direction, of the process cartridge in the movable guide 101 in the cartridge mounting position, showing how the process cartridge has been positioned relative to the image forming apparatus main assembly (movable guide 101). FIG. 13 is a vertical sectional view, in a plane parallel to the cartridge mounting direction, of the process cartridge, after it has been placed in the final position in the image forming apparatus main assembly, by the complete closing of the door 16.

Referring to FIGS. 12 and 13, the position of the movable guide 101, in which cartridges are to be mounted into the movable guide 101, will be described with reference to cartridge Bk, that is, the topmost cartridge in the image forming apparatus 100. The cartridges other than the black process cartridge are not shown in the drawings. The portions of the movable guide 101, into which the other cartridges are mounted, are identical in structure to the portion of the movable guide 101, into which the black process cartridge is mounted.

The cartridge 2 is provided with a pair of ribs 80, which are at both ends of the cartridge 2, one for one, in terms of the direction perpendicular to the direction in which the cartridge is mounted or removed. The ribs 80 are the portions of the cartridge 2, by which the cartridge 2 is guided, while being supported, by the apparatus main assembly 100.

More specifically, the ribs 80 are integral portions of the ends of the cartridge 2 in terms of the lengthwise direction of photosensitive drum 21.

One of the lengthwise ends (right end) of the cartridge 2 is provided with a first driving force transmission portion 78, in the form of a coupler, to which the driving force for rotating the photosensitive drum 21 is transmitted from the apparatus main assembly 100, and a second driving force transmission portion 79 to which the driving force for rotating the development roller 22 and stirring member 74 is transmitted. The guiding surface 80*a* as a part of the guiding portion 80 is above the two driving force transmission portions 78 and 79. It is a part of the top surface of the drum frame 24.

The guiding surface 80*b* as another part of the guiding portion 80 is below the two driving force transmission portions 78 and 79. It is a part of the bottom surface of the development frame 71.

The other lengthwise end of the cartridge 2 is provided with electrical contacts 81*a* and 81*b* for applying voltage to the processing means. The guiding surface 80*c* as another part of the guiding portion 80 is above the electrical contacts 81*a* and 81*b*. It is a part of the top surface of the drum frame 24.

The guiding surface 80*d* as another part of the guiding portion is below the electrical contact 81*a* and 81*b*. It is a part of the bottom surface of the development frame 71.

The electrical contact 81*a* is the electrical contact through which the charge bias to be applied to the charge roller 23 is received from the apparatus main assembly 100. The electrical contact 81*b* is the electrical contact through which the development bias to be charged to the development roller 22 is received from the apparatus main assembly 100.

The apparatus main assembly 100 is provided with guiding ribs 101*a-a* and 101*b-a* (FIG. 3), which correspond in position to the guiding portions 80 of the cartridge 2.

Referring to FIG. 12, the development frame 71 is provided with a rotation controlling portion 82 as a third cartridge positioning portion, which is located forward of the guiding portion 80 in terms of the direction in which the cartridge 2 is mounted into the apparatus main assembly 100. The rotation controlling portion 82 is shaped so that it also functions as the guide for placing the cartridge 2 on the guiding rib 101*a-a* of the movable guide 101. The guiding rib 101*a-a* is provided with a cartridge positioning surface 101*a-f*, which is a part of the inward end portion of the guiding rib 101*a-a*, and opposes the rotation controlling portion 82 when the cartridge 2 is entirely rested on the guiding rib 101*a-a*.

Next, the mechanism for positioning the cartridge 2 relative to the apparatus main assembly 100 when mounting the cartridge 2 into the apparatus main assembly 100 will be described.

The cartridge 2 is to be inserted into the movable guide 101 when the movable guide 101 is in the cartridge mounting position, into which the movable guide 101 is moved by being pivotally moved outward of the apparatus main assembly 100 by roughly 40° from the image formation position. When the movable guide 101 is in this position, the cartridge 2 can be casually mounted into the movable guide 101 (apparatus main assembly 100).

Referring to FIG. 12, upon insertion of the cartridge 2 into the movable guide 101, the cartridge 2 slides down on the guiding ribs 101*a-a* and 101*b-a*, which are substantially slanted relative to the horizontal plane, because the movable guide 101 is in the cartridge mounting position. Then, slightly before the cartridge 2 reaches the deepest end of the guiding rib 101*a-a* (101*b-a*), the rotation controlling surface

82*a*, which is the bottom surface of the rotation controlling portion 82, comes into contact with the cartridge positioning surface 101*a-f*.

The cartridge positioning surface 101*a-f* is a part of the movable guide 101. More specifically, the cartridge positioning surface 101*a-f* is a part of the downstream end portion of the movable guide 101, in terms of the cartridge mounting direction X (FIG. 13), and is slightly stepped up from the upstream side.

Thus, as the cartridge 2 slides down on the guiding ribs 101*a-a* and 101*b-a*, the cartridge positioning surface 82*a*, that is, a part of the bottom surface of the cartridge frame, rides onto the cartridge positioning surface 1011*a-f*.

Next, the door 16 is to be closed. As the door 16 is closed, the movable guide 101 is moved by the above described mechanical linkage connected to the apparatus main assembly 100, into the image formation position 300, that is, the position in which image formation is possible, shown in FIG. 13, in the apparatus main assembly 100. As the movable guide 101 is moved into the image formation position 300, the bearings 27 and 28, which project from the lengthwise ends of the drum frame 24, with their axial lines coinciding with the axial line of the photosensitive drum 21, and which function as cartridge positioning portions as well as bearings, are fitted into the cartridge positioning slots 106*a* of the side walls 106, one for one, of the main frame of the apparatus main assembly 100. As the bearings 27 and 28 are fitted into the positioning slots 106*a*, each of the bearings 27 and 28 is pressed against the rear and bottom surfaces of the corresponding positioning slot 106*a* (106*b*), being thereby fixed in terms of the position relative to the apparatus main assembly 100, and therefore, accurately positioning the axis of the photosensitive drum 21 relative to the apparatus main assembly 100.

The bearings 27 and 28 bear the supporting shaft of the photosensitive drum 21.

Therefore, even when the movable guide 101 is moved into the image formation position (final position) 300, the attitude of the cartridge 2 in terms of its rotational direction is controlled by the contact between the rotation controlling surface 82*a* of the cartridge 2 and the cartridge positioning surface 101*a-f* of the movable guide 101.

Figure 19:
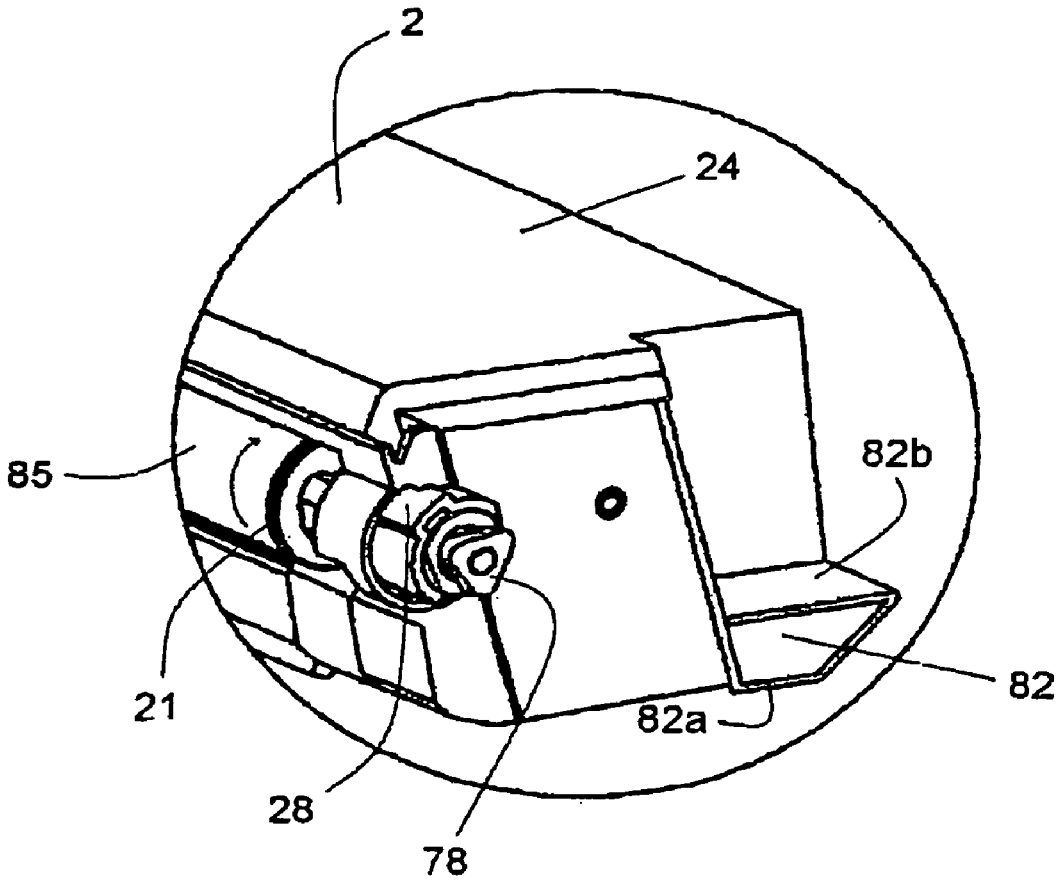
FIG. 19 is a perspective view of one of the lengthwise ends of the process cartridge in accordance with the present invention.

Next, referring to FIGS. 13 and 19, what occurs as the cartridge 2 begins to receive driving force from the image forming apparatus A will be described.

The cartridge 2 is provided with a first driving force transmission portion (coupling) 78, which is at one of the lengthwise ends. The coupling 78 is connected to the supporting shaft of the photosensitive drum 21, and receives the driving force by coupling with the driving force transmitting means (unshown) of the apparatus main assembly 100, rotating thereby the photosensitive drum 21 in the direction indicated by arrow marks (clockwise direction in FIGS. 13 and 19). As the coupling 78 receives the driving force, the drum unit 2*a* is subjected to the rotational moments, that is, the reactive force generated by the driving force, which acts in the direction, indicated by the arrows, to rotate the drum unit 2*a* about the line connecting the axial lines of the bearings 27 and 28 as the first and second cartridge positioning portions, respectively.

As a result, the rotation controlling surface 82*a* comes into contact with the cartridge positioning surface 101*a-f*, catching the moment generated by the transmitted driving force. Therefore, the position of the cartridge 2 relative to the apparatus main assembly 100 becomes fixed, in terms of the direction in which the cartridge 2 is rotated by the driving force it receives from the apparatus main assembly 100.

(Mechanism for Separating Development Roller from Photosensitive Drum)

Figure 14:
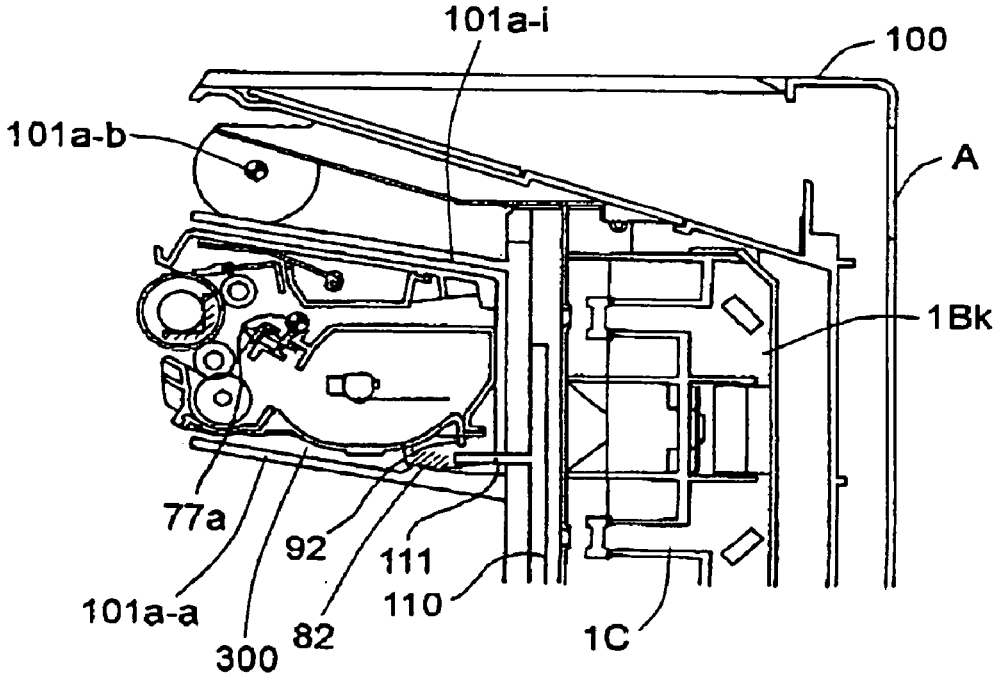
FIG. 14 is a schematic vertical sectional view of the process cartridge, and its adjacencies, in the movable guide of the image forming apparatus, in the preferred embodiment of the present invention, at a plane parallel to the side panel of the apparatus, showing the mechanism for separating the development roller from the photosensitive drum, in the process cartridge.
Figure 15:
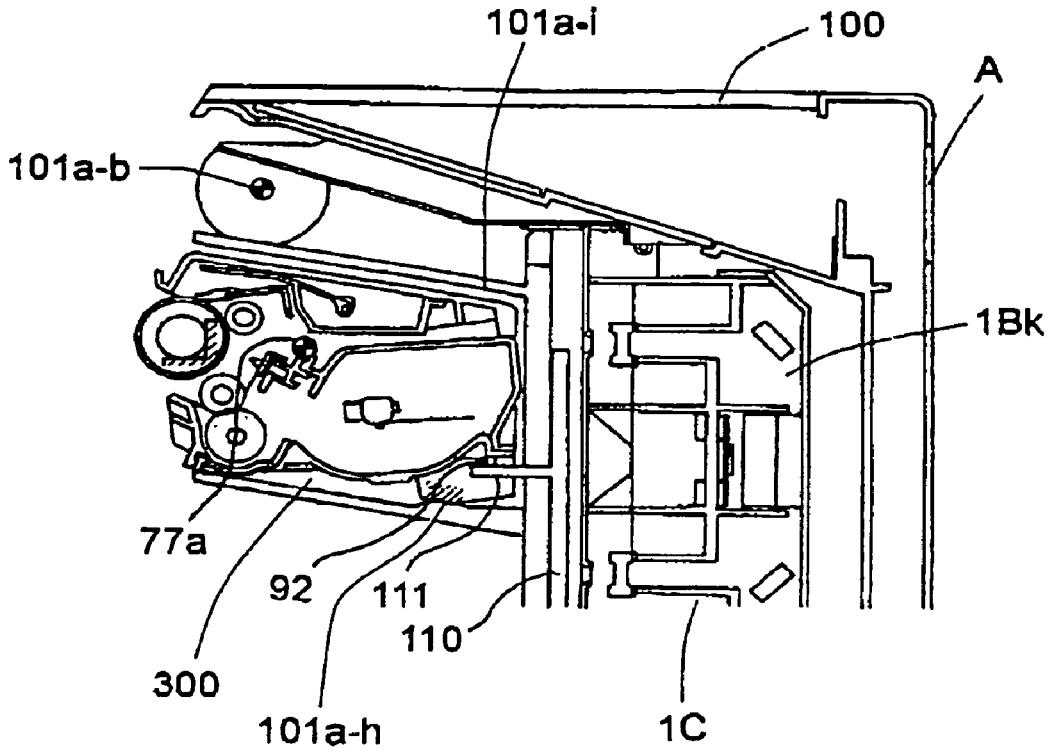
FIG. 15 is a schematic vertical sectional view of the process cartridge in the movable guide of the image forming apparatus, in the preferred embodiment of the present invention, in a plane parallel to the side panel of the apparatus, showing the state of the process cartridge in which the development roller has been separated from the photosensitive drum.
Figure 16:
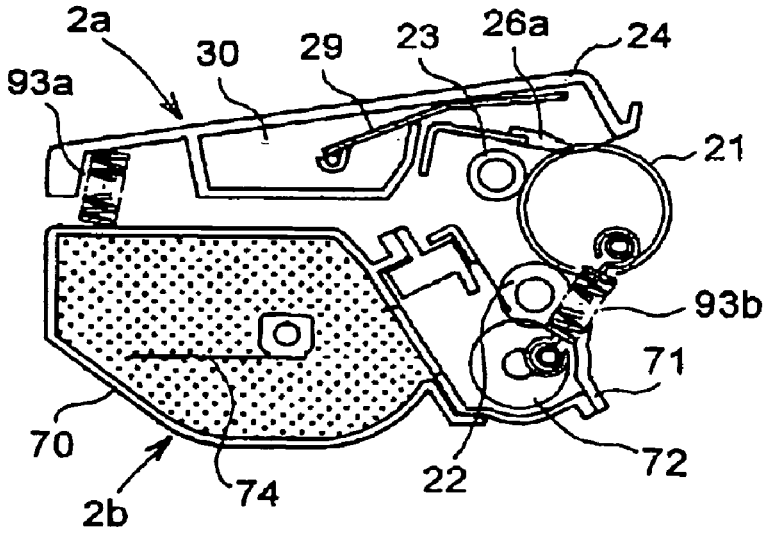
FIG. 16 is a schematic sectional view of the process cartridge in the preferred embodiment of the present invention, in a plane parallel to the direction in which the cartridge is mounted into the movable guide, showing in particular the developer roller pressing member.

Next, referring to FIGS. 14, 15, and 16, the mechanism for separating the development roller 22 from the photosensitive drum 21, in the cartridge 2 in accordance with the present invention when mounting the cartridge 2 into the apparatus main assembly, or removing the cartridge 2 therefrom will be described. FIG. 14 is a schematic sectional view of the process cartridge 2 in accordance with the present invention, and its adjacencies, at a plane perpendicular to the lengthwise direction of the cartridge 2, showing the mechanism for separating the development roller 22 from the photosensitive drum 21, and FIG. 15 is a schematic sectional view of the process cartridge 2 in accordance with the present invention, and its adjacencies, at a plane perpendicular to the lengthwise direction of the cartridge 2, in the state in which the cartridge 2 is in the image forming apparatus main assembly 100, and in which the development roller has been separated from the photosensitive drum 21. FIG. 16 is a schematic sectional view of the process cartridge 2 in accordance with the present invention, at a plane perpendicular to the lengthwise direction of the cartridge 2, showing the developer roller pressing members thereof.

The apparatus main assembly 100 is provided with a separating means 110 for separating the development roller 22 from the photosensitive drum 21 against the resiliency of the pair of compression springs 93 of the cartridge 2. The separating means 110 is located at the deepest (most downstream) end of the apparatus main assembly 100 in terms of the direction in which the cartridge 2 is mounted into the apparatus main assembly 100. It has a developer separating portion (plate) 111 for pushing upward the force catching portion 92, with which the lengthwise end of the development unit 2*b* is provided.

The separating means 110 can be activated by a motor (unshown) to push up the separating plate 111 to the separation point at which there is no contact between the development roller 22 and photosensitive drum 21, or to release the separating plate 111 to allow the separating plate 111 to return to the development point at which the development roller 22 is kept in contact with the photosensitive drum 21; the separating means 110 allows the development unit 2*b* to be in the developing position only during a period in which an image is actually formed.

In this embodiment, the separating plate 111 is pushed up by a stepping motor (unshown) after the positioning of the cartridge 2 into its image formation position, which corresponds to the image formation position 300 of the movable guide 101, in the apparatus main assembly 100. Incidentally, the cartridge 2 is structured so that the development unit 2*b* is suspended with the pair of pins 77*a* from the drum unit 2*a*, being enabled to pivotally move about the pins 77*a*.

Figure 18:
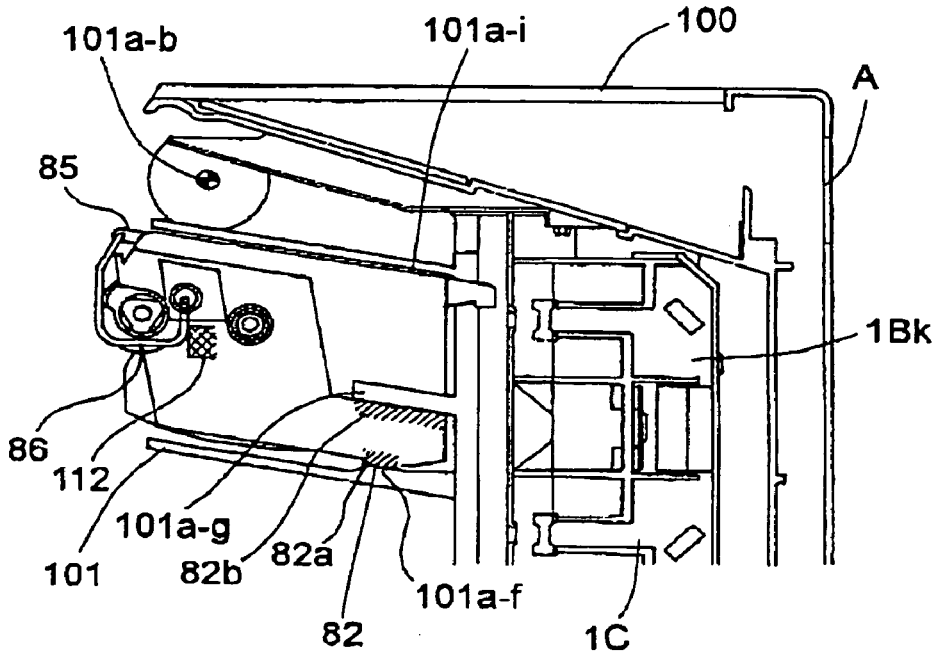
FIG. 18 is a schematic vertical sectional view of the process cartridge in the movable guide of the image forming apparatus, in the preferred embodiment of the present invention, in a plane parallel to the side panel of the apparatus, showing in particular the mechanism for opening or closing the shutter of the process cartridge, in the state in which the process cartridge has been accurately position by the closing of the door of the apparatus main assembly.

Thus, as the separating plate 111 is pushed upward, it comes into contact with the force catching portion 92 of the development unit 2*b*, and pushes the force catching portion 92 upward. As a result, the rotation controlling surface 82*b*, which is the top surface of the rotation controlling portion 82 of the drum unit 2*a*, and which is for controlling the developer roller separating rotation of the cartridge 2, comes into contact with the cartridge catching surface 101*a-g*. which is a part of the guiding rib 101*a* of the movable guide 101, and which corresponds in position to the rotation controlling surface 82*b*, preventing the drum unit 2*a* (cartridge 2) from rotating further upward (FIGS. 18 and 19).

As the drum unit 2*a* is prevented from rotating further upward, the development unit 2*b* is rotated about the pins 77*a*, causing therefore the development roller 22 to separate from the photosensitive drum 21, creating a predetermined distance between the development roller 22 and photosensitive drum 21.

However, as soon as an image forming operation is started by a print signal, the force being applied to push the separating plate 111 upward is stopped in synchronism with the timing of the developing operation, allowing the development roller 22 to be placed in contact with the photosensitive drum 21, that is, readying the development roller 22 for development, so that an image can be formed, After the completion of a given image forming operation, the separating plate 111 is pushed up, and the development roller 22 is kept separated from the photosensitive drum 21. With the provision of this structural arrangement, it is assured that even if the image forming apparatus A is kept unused for a substantial length of time, the problem that the elastic layer of the development roller 22 is permanently deformed by being kept pressed on the photosensitive drum 21 for a substantial length of time will not occur.

Further, the cartridge 2 is structured so that the development unit 2*b* is suspended from the drum unit 2*a*, being allowed to pivotally move relative to the drum unit 2*a*. Therefore, when the cartridge is not under any constraint, the development unit 2*b* is kept pressured by the resiliency of the springs 93, in the direction to keep the development roller 22 in contact with the photosensitive drum 21. Therefore, after the removal of the force which keeps the development roller 22 separated from the photosensitive drum 21, that is, during an image forming operation, the development roller 22 is kept in contact with the photosensitive drum 21 solely by the resiliency of the springs 93, without being affected by the structural arrangement on the apparatus main assembly side. Therefore, a predetermined amount of contact pressure is maintained between the development roller 22 and photosensitive drum 21.

The pair of compression springs 93 may be replaced with a pair of tension springs attached to the lengthwise ends of the cartridge 2, one for one, with one end of each tension spring attached to the portion of the lengthwise end of the drum frame 2*a*, which roughly corresponds in position to the axial line of the photosensitive drum 21, and the other end attached to the portion of the lengthwise end of the development frame 71, which roughly corresponds to the axial line of the development roller 22. In this embodiment, however, a pair of compression springs 93*a* is employed in combination with a pair of tension springs 93*b*.

Also in this embodiment, the bearings 27 (first positioning portion) and 28 (second positioning portion) are accurately positioned relative to the apparatus main assembly 100 by the positioning slots 106*a* and 101*b* of the side walls 106 of the main frame of the apparatus main assembly 100. In other words, their positions are fixed by the apparatus main assembly 100.

Further, the rotational movement of the cartridge 2 about the axial lines of the bearings 27 and 28 caused by the transmission of driving force to the cartridge 2 from the apparatus main assembly 100 is controlled by the rotation controlling portion 82 (positioning surface 82*a*). In other words, the position of the cartridge 2 is also fixed by the movable guide 101.

Therefore, even though the image forming apparatus A is structured so that the cartridges 2 are 15 moved into their image formation positions corresponding to the image formation position 300 of the movable guide 101, in the apparatus main assembly 100, by the movement of the movable guide 101, the cartridges 2 are reliably and accurately positioned relative to the apparatus main assembly 100.

Further, the upward movement of the inward end portion of the cartridge 2, which occurs when separating the development roller 22 from the photosensitive drum 21, is controlled by the rotation controlling portion 82 (positioning surface 82*b*). In other words, the cartridge 2 is fixed in position by the movable guide 101.

Therefore, even though the image forming apparatus A is structured so that the cartridges 2 are moved into their image formation positions corresponding to the image formation position 300 of the movable guide 101, in the apparatus main assembly 100, by the movement of the movable guide 101, the cartridges 2 are kept reliably and accurately positioned relative to the apparatus main assembly 100.

Further, the bottom surface of the rotation controlling portion 82 constitutes the positioning surface 82*a*, and the top surface of the rotation control portion 82 constitutes the positioning surface 82*b*. In addition, the positioning surface 101*a-f* of the movable guide 101 is the top surface of the portion 101*a-h*, which is the slightly thicker portion of the movable guide 101.

Therefore, as the cartridge 2 is inserted into the movable guide 101, and slides deeper into the movable guide 101, the bottom surface of the cartridge 2 rides onto the portion 101*a-h*, reducing thereby the distance between the cartridge 2 and positioning surface 101-*f*, and the distance between the cartridge 2 and the downwardly facing inward surface 101*a-i* of the movable guide 101.

Therefore, the cartridge 2 is prevented from unexpectedly shifting while movable guide 101 is moved.

Further, in this embodiment, the rotation controlling portion 82 is on the side where the first and second driving force transmission portions 78 and 79 are present. Therefore, the rotation of the cartridge 2 can be better controlled. In this case, the three portions, that is, the bearings 27 and 28 and rotation controlling portion 82 of the cartridge 2, remain in contact with the apparatus main assembly 100, accurately positioning the cartridge 2 relative to the apparatus main assembly 100. However, the rotation controlling portion may be on the other side of the cartridge 2, that is, the side opposite to where it is in this embodiment, or may be located at both lengthwise ends of the cartridge 2.

(Mechanism for Opening or Closing Process Cartridge Shutter)

Figure 17:
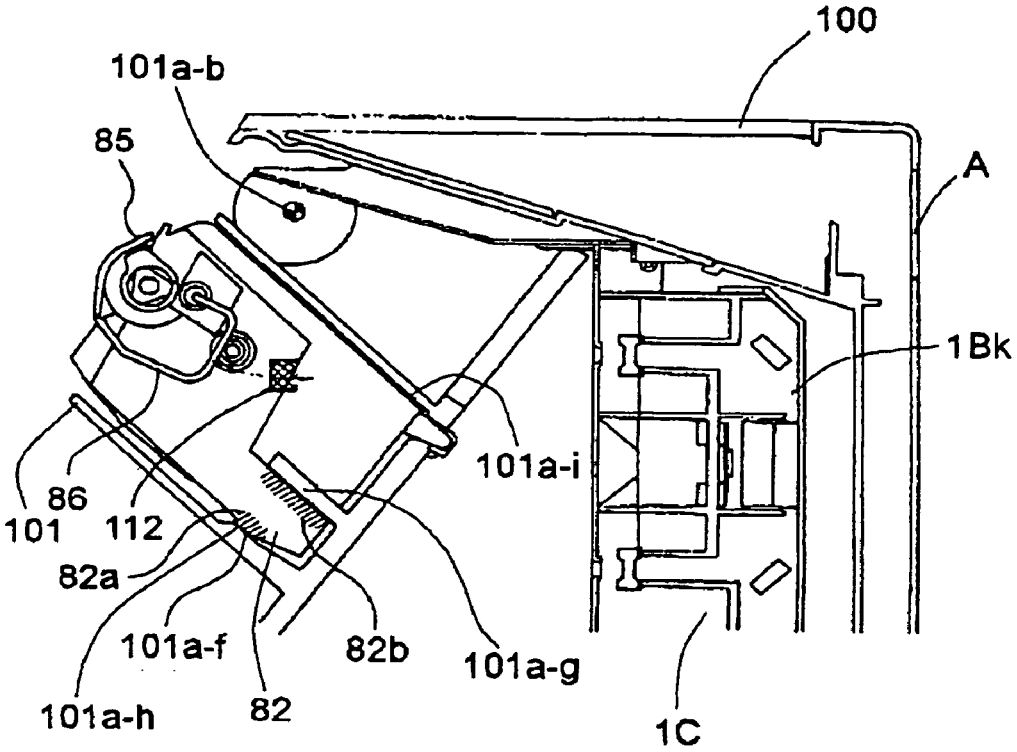
FIG. 17 is a schematic vertical sectional view of the process cartridge in the movable guide of the image forming apparatus, in the preferred embodiment of the present invention, in a plane parallel to the side panel of the apparatus, showing in particular the mechanism for opening or closing the shutter of the process cartridge, in the state in which the process cartridge has been completely mounted into the movable guide which is in the cartridge mounting positioned.

Next, referring to FIGS. 17 and 18, the mechanism for opening or closing the drum shutter which protects the photosensitive drum 21 of the cartridge 2 in accordance with the present invention will be described. FIG. 17 is a schematic sectional view of the cartridge 2 in the movable guide 101 in its cartridge mounting position 200, and its adjacencies, at a plane perpendicular to the lengthwise direction of the cartridge 2, showing the mechanism for opening or closing the shutter, and FIG. 18 is a schematic sectional view of the cartridge 2 in the movable guide 101 in its image formation position 300, and its adjacencies, at a plane perpendicular to the lengthwise direction of the cartridge 2. showing the state of the mechanism for opening or closing the shutter, after the closing of the door 16.

The cartridge 2 is provided with a drum shutter for shielding the peripheral surface of the photosensitive drum 21, which is rotatably attached to the cartridge frame. The shutter comprises a shielding member 85 formed of black resinous substance. and a shutter rod 86. The shutter rod 86 is rotatably attached to the drum unit 2*a* by one end, and is attached to the shielding member 85 by the other. Thus, as the shutter rod 86 is rotated, the shielding member 85 is moved exposing thereby the peripheral surface of the photosensitive drum 21.

When the movable guide 101 is in the cartridge mounting position, the drum shutter of the cartridge(s) 2 in the movable guide 101 is covering the photosensitive drum 21. Then, as the door 16 of the apparatus main assembly 100 is closed, the cartridge(s) 2 is orbitally moved, together with the movable guide 101, into its final position(s), that is, the image formation position(s) which corresponds to the image formation position 300 of the movable guide 101, in the apparatus main assembly 100, by the mechanical linkage connected to the door 16 and movable guide 101. During this movement, the shutter rod 86 of the shutter comes into contact with a shutter controlling member 112 projecting inward from the apparatus main assembly 100, being thereby rotated in the direction to move the shielding member 85 of the shutter in the direction to expose the peripheral surface of the photosensitive drum 21. The shutter controlling member 112 coincides in position with the shutter rod 86, and is in the orbital path of the cartridge 2 from where it is in the movable guide 101 in the cartridge mounting position 200 to its image formation position, that is, its final position in the apparatus main assembly 100, which corresponds to the image formation position 300 of the movable guide 101.

While the cartridge 2 is moving with the movable guide 101, the above described positioning surface 82*a* and rotation controlling surface 82*b* control the attitude of the leading end of the cartridge 2 in the movable guide 101, in terms of the cartridge mounting direction, assuring that the shutter rod 86 will come into contact with the shutter controlling member 112 as the cartridge 2 is orbitally moved into the apparatus main assembly 100, and also that while the shutter is opened by the movement of the cartridge 2 subsequent to the contact between the shutter rod 86 and shutter controlling member 112, the cartridge 2 is prevented from being rattled in the movable guide 101 by the resistance from the shutter, in order to prevent the shutter rod 86 from riding over the shutter controlling member 112. In other words, the positioning surface 82*a* and rotation controlling surface 82*b* serve as rattle controlling means, assuring that the shutter is properly opened.

The above described embodiment of the present invention can be summarized as follows.

The process cartridge 2 in accordance with the present invention is a process cartridge, which is placeable in the movable guide 101 attached to the main assembly 100 of an electrophotographic image forming apparatus A and movable relative to the apparatus main assembly 100 in order to move the cartridge 2 from the cartridge mounting position (200) to the image formation position (300), is characterized in that it comprises:

the electrophotographic photosensitive drum 21;

the processing means (for example, development roller 22, charge roller 23, and cleaning means 26) which act on the electrophotographic photosensitive drum 21;

the first cartridge positioning portion (bearing 27) which is for accurately positioning the process cartridge 2 relative to the apparatus main assembly 100 as the process cartridge 2 is mounted into the apparatus main assembly 100, and which projects outward from one of the lengthwise ends of the cartridge frame (photosensitive drum 24 and development frame 71) in the lengthwise direction of the cartridge 2;

the second cartridge positioning portion (bearing 28) which is for accurately positioning the process cartridge 2 relative to the apparatus main assembly 100 as the process cartridge 2 is mounted into the apparatus main assembly 100, and which projects outward from the other lengthwise end of the cartridge frame (photosensitive drum 24 and development frame 71) in the lengthwise direction of the cartridge 2;

the first cartridge supporting portion (guiding surface 80*d*), by which the cartridge 2 is supported by the movable guide 101, and which is a part of the bottom surface of one of the lengthwise end portions of the cartridge frame (drum frame 24 and development frame 71);

the second cartridge supporting portion (guiding surface 80*b*), by which the cartridge 2 is supported by the movable guide 101, and which is a part of the bottom surface of the other lengthwise end portion of the cartridge frame (drum frame 24 and development frame 71); and the third cartridge positioning portion (rotation controlling portion 82), which is located forward of either the first or second cartridge supporting portion (guiding surface 80*d* or 80*b*), or both, in terms of the direction in which the process cartridge 2 is mounted into the apparatus main assembly 100, and which comprises the first rotation controlling surface (attitude controlling surface 82*a*) with which the process cartridge 2 comes into contact, being thereby prevented from rotating further, as it is rotated about the axial lines of the first and second positioning portions (bearings 27 and 28) by the force generated as driving force is transmitted to the process cartridge 2 from the apparatus main assembly 100.

According to another characteristic aspect of the present invention, the above described process cartridge 2 comprises:

the force catching portion 92 for catching the external force which acts in the direction to separate the development roller 22, as one of the aforementioned processing means, from the photosensitive drum 21, in the process cartridge 2; and the second rotation controlling surface (separation-rotation controlling surface 82*b*) for preventing the process cartridge 2 from being rotating about the first and second positioning portions (bearings 27 and 28) by the external force caught by the force catching portion 92.

According to another characteristic aspect of the present invention, the above described force catching portion 92 is located on the opposite side of the vertical plane which is parallel to the lengthwise direction of the process cartridge 2 and coincides with the axial lines of the connective portions (holes 77 and pins 77*a*) which connect the development frame 71 as a part of the cartridge frame, and the photosensitive drum supporting drum frame 24 as another part of the cartridge frame, in the manner to allow the two frames 71 and 24 to pivotally move relative to each other, with respect to where the development roller 22 is placed in contact with, or separated from, the photosensitive drum 21.

According to another characteristic aspect of the present invention, the third positioning portion (rotation controlling portion 82) is located at the same lengthwise end of the process cartridge 2 as the driving force receiving portions through which the process cartridge 2 receives driving force from the apparatus main assembly 100.

According to another characteristic aspect of the present invention, the third positioning portion (rotation controlling portion 82) is located on the downstream side, in terms of the process cartridge mounting direction, with respect to the driving force receiving portions through which the process cartridge 2 receives driving force from the apparatus main assembly 100.

According to another characteristic aspect of the present invention, the first positioning portion (bearing 27) is accurately positioned relative to the apparatus main assembly 100 by the first positioning portion (positioning slot 106*a*) of the apparatus main assembly 100, whereas the second positioning portion (bearing 28) is positioned relative to the apparatus main assembly 100 by the second positioning portion (positioning slot 106*b*) of the apparatus main assembly 100.

According to another characteristic aspect of the present invention, the axial lines of the first and second positioning portions (bearing 27 and 28) coincide with the axial line of the electrophotographic photosensitive drum 21.

According to another aspect of the present invention, the apparatus main assembly 100 comprises the third cartridge positioning portion, which is an integral part of the leading end portion the movable guide 101 of the apparatus main assembly 100, in terms of the direction in which the process cartridge 2 is mounted into the apparatus main assembly 100, and which comprises: the first rotation controlling surface for preventing the process cartridge 2 from being rotated about the axial lines of the first and second positioning portions by the driving force transmitted from the driving means (unshown) of the apparatus main assembly 100, and the second rotation controlling surface for preventing the process cartridge 2 from being rotated about the axial lines of the first and second positioning portions in the direction to separate the development roller 22 from the photosensitive drum 21 by the external force. The above described characteristics of the present invention provide the following effects.

(1) It is possible to reduce the dimension of the process cartridge 2 in terms of its lengthwise direction, because the parts of the bottom surface of the cartridge frame (drum frame 24 and development frame 71) are utilized as the portions (guiding surfaces 80*b* and 80*d*) by which the process cartridge 2 is supported, and the cartridge positioning surface 82*a* is made integral with the cartridge supporting portions. Therefore, it is possible to reduce the footprint of the image forming apparatus main assembly A.

(2) It is possible to assure that the process cartridge 2 will be accurately positioned relative to the apparatus main assembly 100 with the employment of a simple structural arrangement, because the cartridge attitude controlling surface 82*a* is provided as an integral part of the cartridge supporting portion (guiding surface 80*b*) by which the process cartridge 2 is supported by the apparatus main assembly 100, and is located on the opposite side of the rotation controlling portion 82, with respect to the cartridge attitude controlling surface 82*a*. Therefore, it is possible to reduce the dimension of the process cartridge 2 in terms of its lengthwise direction as described in (1). Therefore, it is possible to reduce the footprint of the image forming apparatus A.

(3) It is possible to prevent the shutter rod 86 from missing, or riding onto, the shutter controlling member 112, in order to assure that the shutter rod 86 will come into contact with the shutter controlling member 112, because the rotation controlling surface 82*a*, and the rotation controlling surface 82*b* for preventing the development unit from rotating in the direction to separate the development roller 22 from the photosensitive drum 21, are positioned so that they comes into contact with the cartridge positioning surface 101*a-f* and 101*a-g*, respectively, of the movable guide 101, controlling thereby the attitude of the process cartridge 2, as the process cartridge 2 is mounted deeper into the movable guide 101. Therefore, it is possible to assure that the shutter will be properly opened.

As described above, according to the present invention, it is assured that a process cartridge will be accurately positioned relative to the main assembly of an electrophotographic image forming apparatus.

While the invention has been described with reference to the structures disclosed herein, it is not confined to the details set forth, and this application is intended to cover such modifications or changes as may come within the purposes of the improvements or the scope of the following claims.

What is claimed is:

1. A process cartridge which is capable of being carried on a movable guide which is movable relative to a main assembly of an electrophotographic image forming apparatus and which is provided in the main assembly of the electrophotographic image forming apparatus, said process cartridge being movable between a receiving position at which the movable guide receives said process cartridge and a mount position where said process cartridge is mounted to the main assembly of the image forming apparatus, said process cartridge being movable from the receiving position toward the mount position in interrelation with movement of the movable guide, said process cartridge comprising:

an electrophotographic photosensitive drum;

a developing roller configured and positioned to develop an electrostatic latent image formed on said electrophotographic photosensitive drum while being in contact with said electrophotographic photosensitive drum;

a drum unit supporting said electrophotographic photosensitive drum;

a developing unit supporting said developing roller, wherein said developing unit and said drum unit are connected at a connecting portion about which said developing unit and said drum unit are rotatable relative to each other;

an elastic member configured and positioned to apply an elastic force between said drum unit and said developing unit so as to cause said electrophotographic photosensitive drum and said developing roller to contact each other;

a first positioning portion to be positioned relative to the main assembly of the electrophotographic image forming apparatus, when said process cartridge is mounted to the main assembly of the electrophotographic image forming apparatus, said first positioning portion extending outwardly from said drum unit adjacent one longitudinal end of said electrophotographic photosensitive drum;

a second positioning portion to be positioned relative to the main assembly of the electrophotographic image forming apparatus, when said process cartridge is mounted to the main assembly of the electrophotographic image forming apparatus, said second positioning portion extending outwardly from said drum unit adjacent the other longitudinal end of said electrophotographic photosensitive drum;

a first portion to be supported, provided at said one longitudinal end of said electrophotographic photosensitive drum, configured and positioned to be supported by the movable guide;

a second portion to be supported, provided at the other longitudinal end of said electrophotographic photosensitive drum, configured and positioned to be supported by the movable guide;

a force receiving portion, provided on said developing unit and configured and positioned to receive, from the main assembly of said electrophotographic image forming apparatus, an external force to separate said developing roller and said electrophotographic photosensitive drum which contact to each other, from each other against the elastic force of said elastic member;

a third positioning portion provided on a leading side of said process cartridge with respect to a mounting direction in which said process cartridge is mounted to the main assembly of the electrophotographic image forming apparatus, wherein said third positioning portion has a first rotation stopper surface configured and positioned to prevent rotation of said process cartridge about said first positioning portion and said second positioning portion by abutting to the movable guide when said process cartridge receives a driving force from the main assembly of the image forming apparatus; and a second rotation stopper surface configured and positioned to stop rotation, by the external force, of said drum unit about said first positioning portion and said second positioning portion by abutment to the movable guide when said force receiving portion receives the external force, wherein said first rotation stopper surface and said second rotation stopper surface are disposed opposed to each other.

2. A process cartridge according to claim 1, wherein said third positioning portion is disposed in the same side of said process cartridge as a side containing a driving force receiving portion configured and positioned to receive the driving force for rotating said electrophotographic photosensitive drum.

3. A process cartridge according to claim 1 or 2 wherein said third positioning portion is disposed downstream of a driving force receiving portion for receiving a driving force for rotating said electrophotographic photosensitive drum, from the main assembly of the electrophotographic image forming apparatus.

4. A process cartridge according to claim 1 or 2 wherein said first positioning portion is positioned with respect to a first main assembly positioning portion provided in the main assembly of the electrophotographic image forming apparatus, and said second positioning portion is positioned with respect to a second main assembly positioning portion provided in the main assembly of the electrophotographic image forming apparatus.

5. A process cartridge according to claim 1, wherein said first positioning portion and said second positioning portion are disposed coaxially with said electrophotographic photosensitive drum.

6. A process cartridge according to claim 2, wherein said first portion to be supported is disposed at said same side, and said third positioning portion is disposed on said first portion to be supported.

7. A process cartridge according to claim 1, 2 or 3 wherein said third positioning portion is disposed at a side of said process cartridge which is opposed to a position of a driving force receiving portion for receiving a driving force for rotating said electrophotographic photosensitive drum from the main assembly of said electrophotographic image forming apparatus, with respect to the longitudinal direction of said electrophotographic photosensitive drum.

8. A process cartridge according to claim 1 or 2, wherein said third positioning portion is disposed at least one of said first portion to be supported and said second portion to be supported.

9. An electrophotographic image forming apparatus to which a process cartridge is detachably mountable, said apparatus comprising:

a main assembly including a movable guide which is movable relative to said main assembly, said process cartridge being movable between a receiving position at which said movable guide receives said process cartridge and a mount position where said process cartridge is mounted to said main assembly, said process cartridge including:

an electrophotographic photosensitive drum;

a developing roller configured and positioned to develop an electrostatic latent image formed on said electrophotographic photosensitive drum while being in contact with said electrophotographic photosensitive drum;

a drum unit supporting said electrophotographic photosensitive drum;

a developing unit supporting said developing roller, wherein said developing unit and said drum unit are connected at a connecting portion about which said developing unit and said drum unit are rotatable relative to each other;

an elastic member configured and positioned to apply an elastic force between said drum unit and said developing unit so as to cause said electrophotographic photosensitive drum and said developing roller to contact each other;

a first positioning portion to be positioned relative to said main assembly, when said process cartridge is mounted to said main assembly, said first positioning portion extending outwardly from said drum unit adjacent one longitudinal end of said electrophotographic photosensitive drum;

a second positioning portion to be positioned relative to said main assembly, when said process cartridge is mounted to said main assembly, said second positioning portion extending outwardly from said drum unit adjacent the other longitudinal end of said electrophotographic photosensitive drum;

a first portion to be supported, provided at said one longitudinal end of said electrophotographic photosensitive drum, configured and positioned to be supported by said movable guide;

a second portion to be supported, provided at the other longitudinal end of said electrophotographic photosensitive drum, configured and positioned to be supported by said movable guide;

a force receiving portion, provided on said developing unit and configured and positioned to receive, from said main assembly, an external force to separate said developing roller and said electrophotographic photosensitive drum which are contacted to each other, from each other against the elastic force of said elastic member;

a third positioning portion provided on a leading side of said process cartridge with respect to a mounting direction in which said process cartridge is mounted to said main assembly, wherein said third positioning portion has a first rotation stopper surface configured and positioned to prevent rotation of said process cartridge about said first positioning portion and said second positioning portion by abutting to said movable guide when said process cartridge receives a driving force from said main assembly; and a second rotation stopper surface configured and positioned to stop rotation, by the external force, of said drum unit about said first positioning portion and said second positioning portion by abutment to said movable guide when said force receiving portion receives the external force, wherein said first rotation stopper surface and said second rotation stopper surface are disposed opposed to each other.

10. An apparatus according to claim 9 wherein said third positioning portion is disposed in the same side of said process cartridge as a side containing a driving force receiving portion configured and positioned to receive the driving force to rotate said electrophotographic photosensitive drum.

11. An apparatus according to claim 9 or 10, wherein said third positioning portion is disposed downstream of a driving force receiving portion for receiving a driving force for rotating said electrophotographic photosensitive drum, from said main assembly.

12. An apparatus according to claim 9 or 10, wherein said first positioning portion is positioned with respect to a first main assembly positioning portion provided in said main assembly, and said second positioning portion is positioned with respect to a second main assembly positioning portion provided in said main assembly.

13. An apparatus according to claim 9, wherein said first positioning portion and said second positioning portion are disposed coaxially with said electrophotographic photosensitive drum.

14. An electrophotographic image forming apparatus for forming an image on a recording material, to which a process cartridge is detachably mountable, said electrophotographic image forming apparatus comprising:

(i) a movable guide which is movable relative to a main assembly of said electrophotographic image forming apparatus; and (ii) said process cartridge, which is movable between a receiving position at which said movable guide receives said process cartridge and a mount position where said process cartridge is mounted to the main assembly of said electrophotographic image forming apparatus, said process cartridge including:

an electrophotographic photosensitive drum;

a developing roller configured and positioned to develop an electrostatic latent image formed on said electrophotographic photosensitive drum while being in contact with said electrophotographic photosensitive drum;

a drum unit supporting said electrophotographic photosensitive drum;

a developing unit supporting said developing roller, wherein said developing unit and said drum unit are connected at a connecting portion about which said developing unit and said drum unit are rotatable relative to each other;

an elastic member configured and positioned to apply an elastic force between said drum unit and said developing unit so as to cause said electrophotographic photosensitive drum and said developing roller to contact each other;

a first positioning portion to be positioned relative to the main assembly of said electrophotographic image forming apparatus, when said process cartridge is mounted to the main assembly of said electrophotographic image forming apparatus, said first positioning portion extending outwardly from said drum unit adjacent one longitudinal end of said electrophotographic photosensitive drum;

a second positioning portion to be positioned relative to the main assembly of said electrophotographic image forming apparatus, when said process cartridge is mounted to the main assembly of the electrophotographic image forming apparatus, said second positioning portion extending outwardly from said drum unit adjacent the other longitudinal end of said electrophotographic photosensitive drum;

a first portion to be supported, provided at said one longitudinal end of said electrophotographic photosensitive drum, configured and positioned to be supported by said movable guide;

a second portion to be supported, provided at the other longitudinal end of said electrophotographic photosensitive drum, configured and positioned to be supported by said movable guide;

a force receiving portion, provided on said developing unit and configured and positioned to receive, from the main assembly of said electrophotographic image forming apparatus, an external force to separate said developing roller and said electrophotographic photosensitive drum which are contacted to each other, from each other against the elastic force of said elastic member;

a third positioning portion provided on a leading side of said process cartridge with respect to a mounting direction in which said process cartridge is mounted to the main assembly of said electrophotographic image forming apparatus, wherein said third positioning portion has a first rotation stopper surface configured and positioned to prevent rotation of said process cartridge about said first positioning portion and said second positioning portion by abutting to said movable guide when said process cartridge receives a driving force from the main assembly of said image forming apparatus; and a second rotation stopper surface configured and positioned to stop rotation, by the external force, of said drum unit about said first positioning portion and said second positioning portion by abutment to the movable guide when said force receiving portion receives the external force, wherein said first rotation stopper surface and said second rotation stopper surface are disposed opposed to each other.

15. A process cartridge according to claim 7, further comprising a developing roller driving force receiving portion configured and positioned to receive a driving force for rotating said developing roller from the main assembly of said electrophotographic image forming apparatus at the same side of said process cartridge as the portion where a drum driving force receiving portion is disposed.

16. A process cartridge according to claim 15, wherein said third positioning portion is disposed at a leading side of said process cartridge with respect to a mounting direction in which said process cartridge is mounted to the main assembly of said electrophotographic image forming apparatus.

* * * * *

UNITED STATES PATENT AND TRADEMARK OFFICE

CERTIFICATE OF CORRECTION

PATENT NO. : 7,127,194 B2
APPLICATION NO. : 10/745984
DATED : October 24, 2006
INVENTOR(S) : Nobuharu Hoshi et al.

It is certified that error appears in the above-identified patent and that said Letters Patent is hereby corrected as shown below:

COLUMN 1:
Line 20, “an-electrophotographic” should read --an electrophotographic--.
Line 63, “electrophoto-graphic” should read --electrophotographic--.
Line 65, “opment.” should read --opment--.

COLUMN 2:
Line 10, “electrophoto-graphic” should read --electrophotographic--.
Line 16, “guide.” should read --guide,--; and “tile” should read --the--.
Line 37, “above described” should read --above-described--.
Line 42, “cartridge” should read --cartridge,--.
Line 50, “cartridge” should read --cartridge,--.
Line 60, “cartridge”” should read --cartridge--.

COLUMN 3:
Line 9, “portion” should read --portion,--.
Line 35, “invention.” should read --invention,--.
Line 44, “invention.” should read --invention,--.
Line 48, “invention.” should read --invention,--.

COLUMN 4:
Line 63, “position” should read --positioned--.

COLUMN 5:
Line 20, “cartridge:” should read --cartridge,--.

COLUMN 8:
Line 5, “Pare” should read --P are--.
Line 67, “above described” should read --above-described--.

COLUMN 11:
Line 14, “above described” should read --above-described--.
Line 34, “movements” should read --movements to--.
Line 45, “above described” should read --above-described--.

COLUMN 15:
Line 16, “above described” should read --above-described--.

UNITED STATES PATENT AND TRADEMARK OFFICE

CERTIFICATE OF CORRECTION

PATENT NO. : 7,127,194 B2
APPLICATION NO. : 10/745984
DATED : October 24, 2006
INVENTOR(S) : Nobuharu Hoshi et al.

It is certified that error appears in the above-identified patent and that said Letters Patent is hereby corrected as shown below:

COLUMN 18:
Line 62, “cartridge 2.” should read --cartridge 2,--.

COLUMN 19:
Line 2, “substance.” should read --substance--.
Line 32, “above described” should read --above-described--.
Line 48, “above described” should read --above-described--.

COLUMN 20:
Line 36, “above described” should read --above-described--.
Line 49, “above described” should read --above-described--.

COLUMN 21:
Line 34, “above” should read --above- --.

COLUMN 22:
Line 1, “comes” should read --come--.

COLUMN 23:
Line 10, “to” should be deleted.
Line 38, “claim 1 or 2” should read --claim 1 or 2,--.
Line 44, “claim 1 or 2” should read --claim 1 or 2,--.

COLUMN 25:
Line 12, “claim 9” should read --claim 9,--.

Signed and Sealed this

Tenth Day of February, 2009

John Doll

JOHN DOLL
*Acting Director of the United States Patent and Trademark Office*